US012203344B2

(12) United States Patent
Steele et al.

(10) Patent No.: US 12,203,344 B2
(45) Date of Patent: Jan. 21, 2025

(54) DOWNHOLE TOOL WITH A RELEASABLE SHROUD AT A DOWNHOLE TIP THEREOF

(71) Applicant: Halliburton Energy Services, Inc., Houston, TX (US)

(72) Inventors: David Joe Steele, Carrollton, TX (US); Srinivasa Prasanna Vemuri, Frisco, TX (US); Stacey Blaine Donovan, Fort Worth, TX (US); Morten Falnes, Sola (NO); Wesley Paul Dietz, Carrollton, TX (US); Christian Alexander Ramirez, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/118,019

(22) Filed: Dec. 10, 2020

(65) Prior Publication Data

US 2021/0172306 A1 Jun. 10, 2021

Related U.S. Application Data

(60) Provisional application No. 62/946,219, filed on Dec. 10, 2019.

(51) Int. Cl.
*E21B 23/02* (2006.01)
*E21B 17/18* (2006.01)
(Continued)

(52) U.S. Cl.
CPC ..... *E21B 41/0035* (2013.01); *E21B 17/18* (2013.01); *E21B 23/00* (2013.01);
(Continued)

(58) Field of Classification Search
CPC . E21B 23/00; E21B 17/00; E21B 7/04; E21B 7/046; E21B 7/06; E21B 7/061; E21B 23/02
See application file for complete search history.

(56) References Cited

U.S. PATENT DOCUMENTS 3,542,404 A 11/1970 Crews
5,284,208 A * 2/1994 Clemens ..... E21B 23/08 166/383
(Continued)

FOREIGN PATENT DOCUMENTS

CN 105089565 11/2015
CN 106471209 3/2017
(Continued)

OTHER PUBLICATIONS

Dyer, S., et al., "New Intelligent Completion System Enables Compartment-Level Control in Multilateral Wells," Journal of Petroleum Technology, Aug. 15, 2016, vol. 68, Issue 9, 6 pages, https://pubs.spe.org/en/jpt/jpt-article-detail/?art=1385.

*Primary Examiner* — Kenneth L Thompson
(74) *Attorney, Agent, or Firm* — Scott Richardson; Parker Justiss, P.C.

(57) ABSTRACT

Provided is a downhole tool, a y-block, a well system, and a method for forming a well system. The downhole tool, in one aspect, includes a bottom hole assembly (BHA) having an uphole end and a downhole end, and a shroud positioned around and proximate the downhole end of the BHA, the shroud operable to slide relative to the BHA. The downhole tool, in this aspect, may further include one or more shear features coupling the shroud to the downhole end of the BHA.

23 Claims, 20 Drawing Sheets

(51) Int. Cl.

| | |
|---|---|
| ***E21B 23/00*** | (2006.01) |
| ***E21B 41/00*** | (2006.01) |
| ***E21B 43/26*** | (2006.01) |
| *E21B 23/12* | (2006.01) |
| *E21B 43/14* | (2006.01) |

(52) U.S. Cl.
CPC ..... *E21B 23/02* (2013.01); *E21B 41/0042* (2013.01); *E21B 43/26* (2013.01); *E21B 23/12* (2020.05); *E21B 43/14* (2013.01)

(56) References Cited

U.S. PATENT DOCUMENTS

| | | | | |
|---|---|---|---|---|
| 5,435,392 | A | 7/1995 | Kennedy | |
| 5,462,120 | A | 10/1995 | Gondouin | |
| 5,979,560 | A | 11/1999 | Nobileau | |
| 6,047,774 | A | 4/2000 | Allen | |
| 6,056,059 | A | 5/2000 | Ohmer | |
| 6,089,320 | A | 7/2000 | LaGrange | |
| 6,276,457 | B1 * | 8/2001 | Moffatt | E21B 19/22 166/381 |
| 6,283,216 | B1 | 9/2001 | Ohmer | |
| 6,354,375 | B1 | 3/2002 | Dewey | |
| 6,431,283 | B1 | 8/2002 | Dale | |
| 6,712,148 | B2 | 3/2004 | Fipke et al. | |
| 6,863,129 | B2 | 3/2005 | Ohmer et al. | |
| 6,907,930 | B2 | 6/2005 | Cavender et al. | |
| 6,915,847 | B2 | 7/2005 | Brockman | |
| 7,299,878 | B2 | 11/2007 | Steele | |
| 7,350,569 | B2 * | 4/2008 | Collins | E21B 33/12 166/242.6 |
| 7,779,924 | B2 * | 8/2010 | Clamens | E21B 33/124 166/387 |
| 7,980,311 | B2 * | 7/2011 | Dowling | E21B 31/107 166/334.1 |
| 8,397,819 | B2 | 3/2013 | Tunget | |
| 8,695,694 | B1 | 4/2014 | Lajesic | |
| 8,701,775 | B2 | 4/2014 | Steele | |
| 8,967,277 | B2 | 3/2015 | Steele et al. | |
| 8,985,203 | B2 | 3/2015 | Stokes et al. | |
| 9,133,675 | B2 * | 9/2015 | Telfer | E21B 23/04 |
| 9,133,697 | B2 | 9/2015 | Cavender et al. | |
| 9,140,082 | B2 | 9/2015 | Lajesic | |
| 9,140,102 | B2 | 9/2015 | Bartko et al. | |
| 9,194,213 | B2 * | 11/2015 | Macleod | E21B 33/12 |
| 9,243,465 | B2 | 1/2016 | Lajesic | |
| 9,260,945 | B2 | 2/2016 | Lajesic et al. | |
| 9,394,778 | B2 | 7/2016 | Anders | |
| 9,638,008 | B2 | 5/2017 | Stokes et al. | |
| 9,803,438 | B2 | 10/2017 | Stokes et al. | |
| 9,822,612 | B2 | 11/2017 | Steele et al. | |
| 9,874,062 | B2 | 1/2018 | Lajesic et al. | |
| 10,012,045 | B2 | 7/2018 | Lajesic | |
| 10,036,220 | B2 | 7/2018 | Lajesic et al. | |
| 10,060,225 | B2 | 8/2018 | Wolf et al. | |
| 10,167,684 | B2 | 1/2019 | Steele | |
| 10,196,880 | B2 | 2/2019 | Steele et al. | |
| 10,240,434 | B2 | 3/2019 | Steele et al. | |
| 10,352,140 | B2 | 7/2019 | Parlin et al. | |
| 10,435,993 | B2 | 10/2019 | Steele | |
| 10,465,452 | B2 | 11/2019 | Parlin | |
| 10,655,433 | B2 | 5/2020 | Hepburn et al. | |
| 10,731,417 | B2 | 8/2020 | Vemuri et al. | |
| 11,203,913 | B2 * | 12/2021 | Martin | E21B 33/129 |
| 11,371,305 | B2 * | 6/2022 | Mickey | E21B 33/128 |
| 2001/0025710 | A1 | 10/2001 | Ohmer et al. | |
| 2003/0029613 | A1 | 2/2003 | Danos et al. | |
| 2003/0062717 | A1 | 4/2003 | Thomas et al. | |
| 2005/0230121 | A1 | 10/2005 | Martinez et al. | |
| 2005/0241830 | A1 | 11/2005 | Steele | |
| 2007/0089875 | A1 | 4/2007 | Steele et al. | |
| 2007/0227727 | A1 | 10/2007 | Patel et al. | |
| 2010/0163240 | A1 | 7/2010 | Ingraham et al. | |
| 2010/0170677 | A1 | 7/2010 | Ingraham | |
| 2010/0276158 | A1 | 11/2010 | Ingraham | |
| 2012/0305268 | A1 | 12/2012 | Steele | |
| 2013/0081807 | A1 | 4/2013 | Dyer et al. | |
| 2013/0306324 | A1 | 11/2013 | Tunget | |
| 2014/0345861 | A1 | 11/2014 | Stalder et al. | |
| 2015/0068756 | A1 | 3/2015 | Pendleton | |
| 2015/0233190 | A1 | 8/2015 | Wolf et al. | |
| 2015/0275587 | A1 | 10/2015 | Wolf et al. | |
| 2015/0376955 | A1 | 12/2015 | Wolf et al. | |
| 2016/0273312 | A1 | 9/2016 | Steele et al. | |
| 2016/0290079 | A1 | 10/2016 | Lajesic | |
| 2016/0348476 | A1 | 12/2016 | Stokes et al. | |
| 2017/0130537 | A1 | 5/2017 | Parlin | |
| 2017/0328177 | A1 | 11/2017 | Sheehan et al. | |

FOREIGN PATENT DOCUMENTS

| | | | |
|---|---|---|---|
| CN | 105829639 | | 5/2019 |
| EP | 2358974 | | 10/2016 |
| EP | 2715041 | | 1/2019 |
| EP | 3025005 | B1 | 3/2019 |
| RU | 2436925 | C2 | 12/2011 |
| RU | 2518701 | C2 | 6/2014 |
| RU | 2588999 | C2 | 7/2016 |
| RU | 2608375 | C2 | 1/2017 |
| RU | 2655517 | C2 | 5/2018 |
| RU | 2687729 | C1 | 5/2019 |
| RU | 2719842 | C2 | 4/2020 |
| WO | 0026501 | | 5/2000 |
| WO | 2015030842 | A1 | 3/2015 |
| WO | 2016010530 | A1 | 1/2016 |
| WO | 2019027454 | A1 | 2/2019 |

* cited by examiner

DOWNHOLE TOOL WITH A RELEASABLE SHROUD AT A DOWNHOLE TIP THEREOF

CROSS-REFERENCE TO RELATED APPLICATION

This application claims the benefit of U.S. Provisional Application Ser. No. 62/946,219, filed on Dec. 10, 2019, entitled "HIGH PRESSURE MIC WITH MAINBORE AND LATERAL ACCESS AND CONTROL", incorporated herein by reference in its entirety.

BACKGROUND

A variety of selective borehole pressure operations require pressure isolation to selectively treat specific areas of the wellbore. One such selective borehole pressure operation is horizontal multistage hydraulic fracturing ("frac" or "fracking"). In multilateral wells, the multistage stimulation treatments are performed inside multiple lateral wellbores. Efficient access to all lateral wellbores is critical to complete successful pressure stimulation treatment.

BRIEF DESCRIPTION

Reference is now made to the following descriptions taken in conjunction with the accompanying drawings, in which.

DETAILED DESCRIPTION

Figure 1:
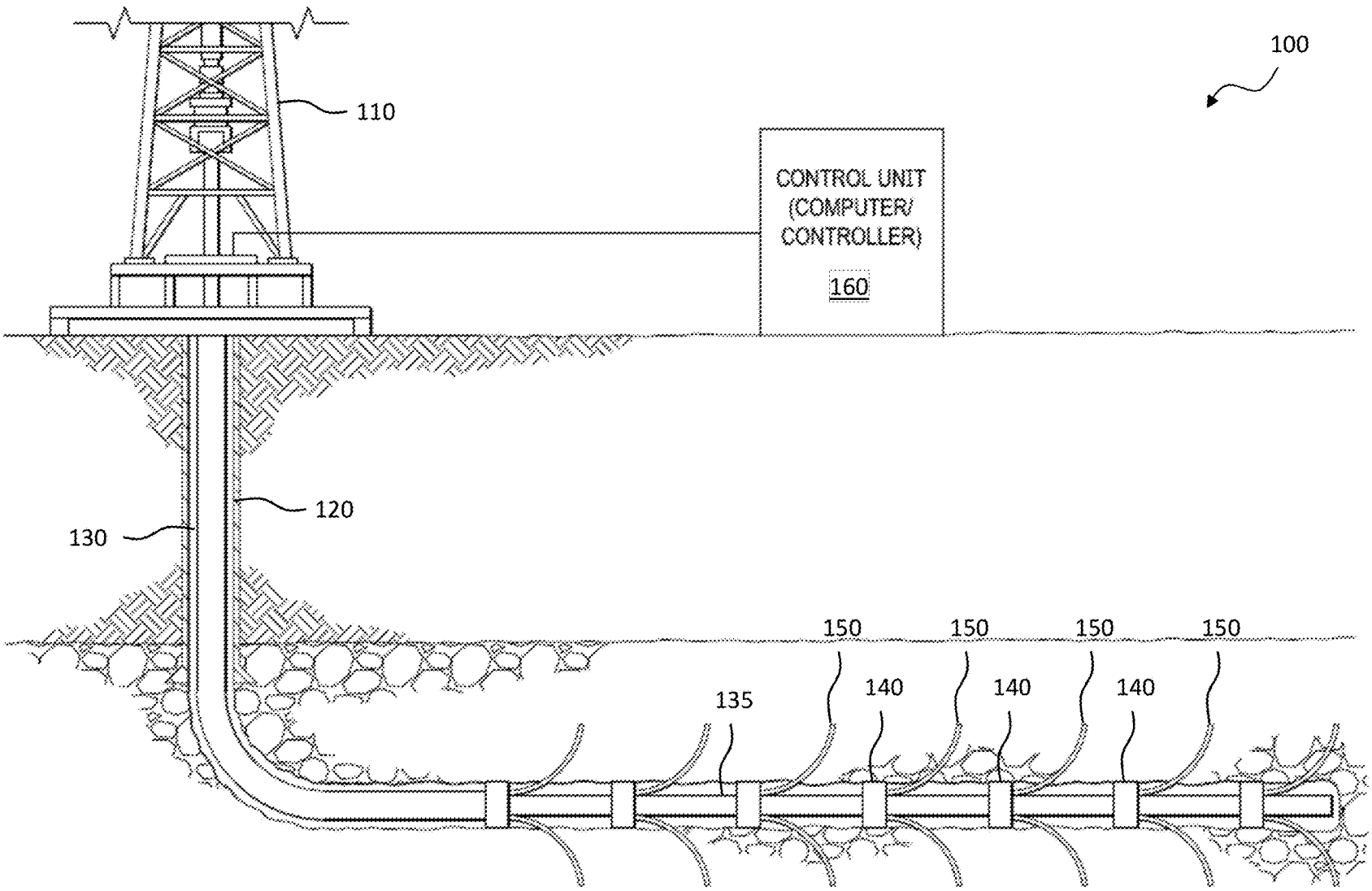
FIG. 1 illustrates a well system for hydrocarbon reservoir production, the well system including a y-block designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. In such instances, the terms "up," "upper," "upward," "uphole," "upstream," or other like terms shall be used to represent the toward the surface end of a well. Unless otherwise specified, use of the term "subterranean formation" shall be construed as encompassing both areas below exposed earth and areas below earth covered by water such as ocean or fresh water.

A particular challenge for the oil and gas industry is developing a pressure tight TAML (Technology Advancement of Multilaterals) level 5 multilateral junction that can be installed in casing (e.g., 7⅝" casing) and that also allows for ID access (e.g., ~3½" ID access) to a main wellbore after the junction is installed. This type of multilateral junction could be useful for coiled tubing conveyed stimulation and/or clean-up operations. It is envisioned that future multilateral wells will be drilled from existing slots/wells where additional laterals are added to the existing wellbore. If a side track can be made from the casing (e.g., 9⅝" casing), there is an option to install a liner (e.g., 7" or 7⅝" liner) with a new casing exit point positioned at an optimal location to reach undrained reserves.

Referring now to FIG. 1, illustrated is a diagram of a well system 100 for hydrocarbon reservoir production, according to certain example embodiments. The well system 100 in one or more embodiments includes a pumping station 110, a main wellbore 120, tubing 130, 135, which may have differing tubular diameters, and a plurality of multilateral junctions 140, and lateral legs 150 with additional tubing integrated with a main bore of the tubing 130, 135. Each multilateral junction 140 may comprise a junction designed, manufactured or operated according to the disclosure, including a multilateral junction comprising a novel y-block according to the disclosure. The well system 100 may additionally include a control unit 160. The control unit 160, in this embodiment, is operable to control to and/or from the multilateral junctions and/or lateral legs 150, as well as other devices downhole.

Figure 2A:
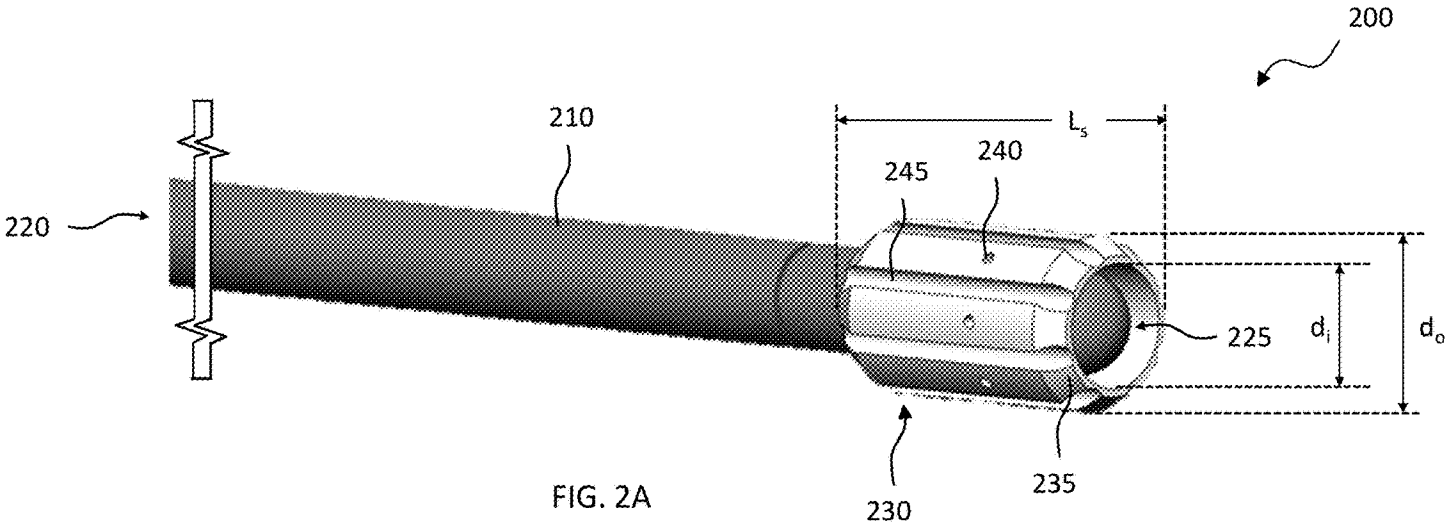
FIG. 2A illustrates a perspective view of a downhole tool designed, manufactured and operated according to one or more embodiments of the disclosure.

Turning to FIG. 2A, illustrated is a perspective view of a downhole tool 200 designed, manufactured and operated according to one or more embodiments of the disclosure. The downhole tool 200, in the illustrated embodiment, includes a bottom hole assembly (BHA) 210. The BHA 210, in the illustrated embodiment, includes an uphole end 220 and a downhole end 225. The BHA 210, in many embodiments, may be coupled to a long conveyance. For example, in one embodiment the long conveyance is coiled tubing or wireline that would extend from a downhole location in a wellbore to a surface of the wellbore. Accordingly, the BHA 210 in certain embodiments may extend hundreds of meters, if not thousands of meters, into the wellbore. In the embodiment wherein the BHA 210 is coupled to coiled tubing, the BHA 210 could be a stimulation BHA used for fracturing a subterranean formation of a main wellbore or alternatively a lateral wellbore.

The downhole tool 200, in one or more embodiments, additionally includes a shroud 230 positioned around and proximate the downhole end 225 of the BHA 210. The shroud 230, in the illustrated embodiment, is operable to slide relative to the BHA 210. The shroud 230, in the illustrated embodiment, includes a rounded nose 235 proximate a downhole end thereof. The rounded nose 235, in this embodiment, is configured to engage with a recess feature in a leg of a y-block, as might be positioned at an intersection between a main wellbore and a lateral wellbore. In an alternative embodiment, however, the shroud 230 might have a square nose or other useful shaped nose.

The shroud 230, in certain embodiments, may have one or more fluid passageways 245 extending along a length ($L_s$) thereof. The fluid passageways 245, in this embodiment, allow the shroud 230 to traverse downhole within a wellbore tubular while allowing fluid there below to pass there above. The fluid passageways 245 also help maintain a higher flow area through the shroud 230 if an annular prop frac is required. The one or more fluid passageways 245, in the illustrated embodiment, are one or more flutes extending along the length ($L_s$) of an outer surface thereof. Nevertheless, in another embodiment, the one or more fluid passageways 245 are one or more openings in a sidewall thickness extending along the length ($L_s$) of the shroud 230. Yet, other different types of fluid passageways 245 are within the scope of the disclosure.

The downhole tool 200, in at least one or more embodiments, additionally includes one or more shear features 240 coupling the shroud 230 to the downhole end 225 of the BHA 210. The one or more shear features 240, in this embodiment, removably fix the shroud 230 to the BHA 210, for example while running the downhole tool 200 within a wellbore to a desired location. Any number of shear features 240 may be used, so long as the collective shear force required to shear the shear features 240 exceeds the drag and other forms of resistance the downhole tool 200 will encounter as it is being positioned at the desired location within the wellbore. In accordance with this idea, in one embodiment the one or more shear features 240 collectively have a minimum shear force of at least about 200 pounds. Further to this idea, and in a different embodiment, the one or more shear features 240 collectively have a shear force ranging from about 500 pounds to about 10,000 pounds. While any number of shear features 240 may be used, in at least one embodiment, three or more shear features 240 couple the shroud 230 to the downhole end 225 of the BHA 210. Further to this embodiment, the three or more shear features 240 may be radially positioned equal distance around the shroud 230.

While not shown in the view depicted in FIG. 2A, in certain embodiments the BHA 210 has one or more protrusions extending radially outward therefrom. The one or more protrusions, in this embodiment, are operable to catch one or more profiles extending from an inner surface of the shroud 230. In at least one embodiment, the one or more protrusions are positioned downhole of the one or more profiles, such that the one or more protrusions catch the one or more profiles when retrieving the BHA 210 and shroud 230.

Figure 2C:
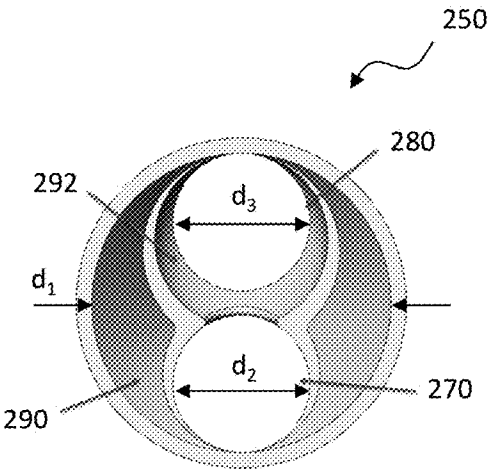
FIGS. 2B and 2C illustrates various different views of a y-block designed, manufactured and operated according to one or more embodiments of the disclosure.
Figure 2B:
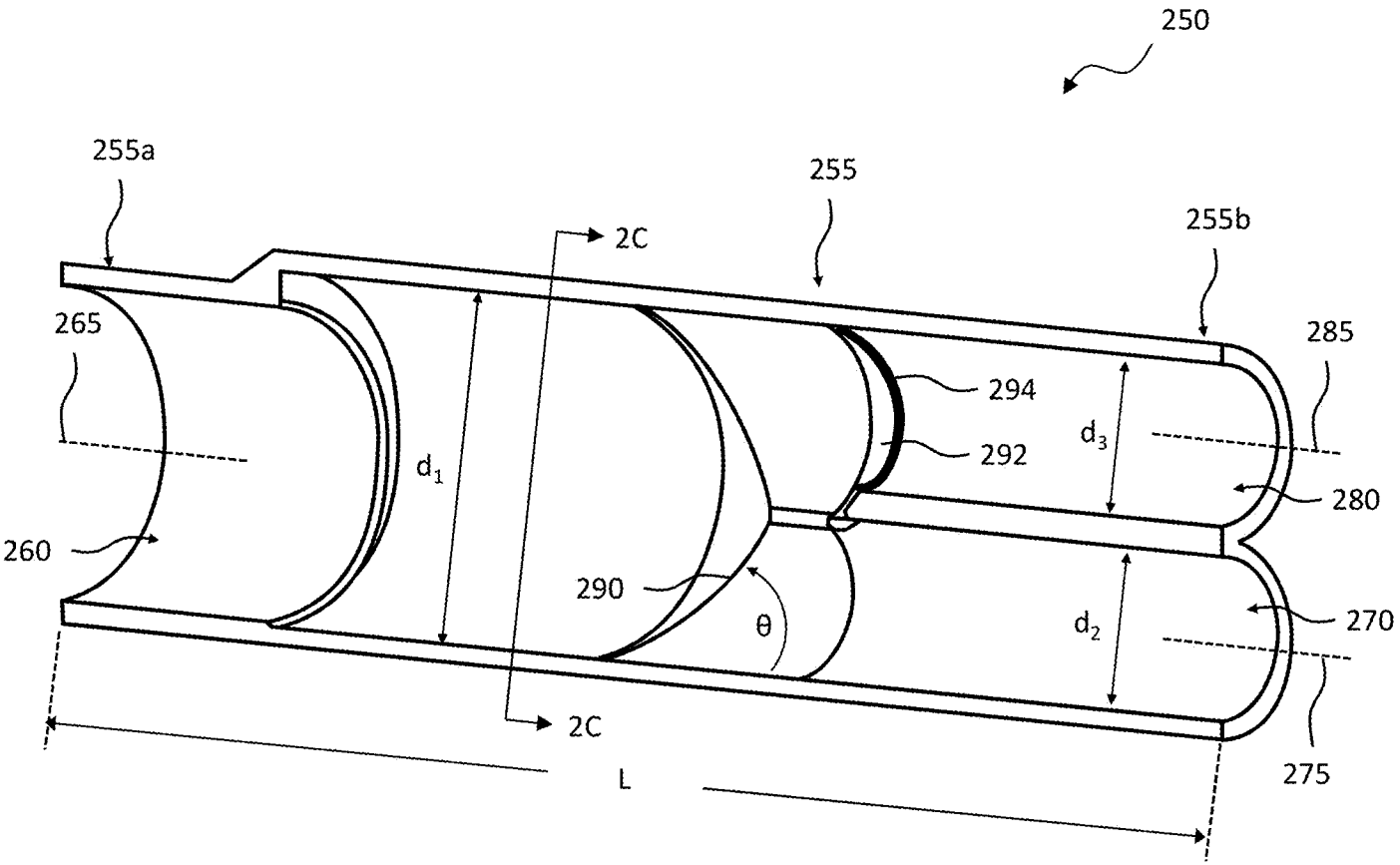
Figure 3:
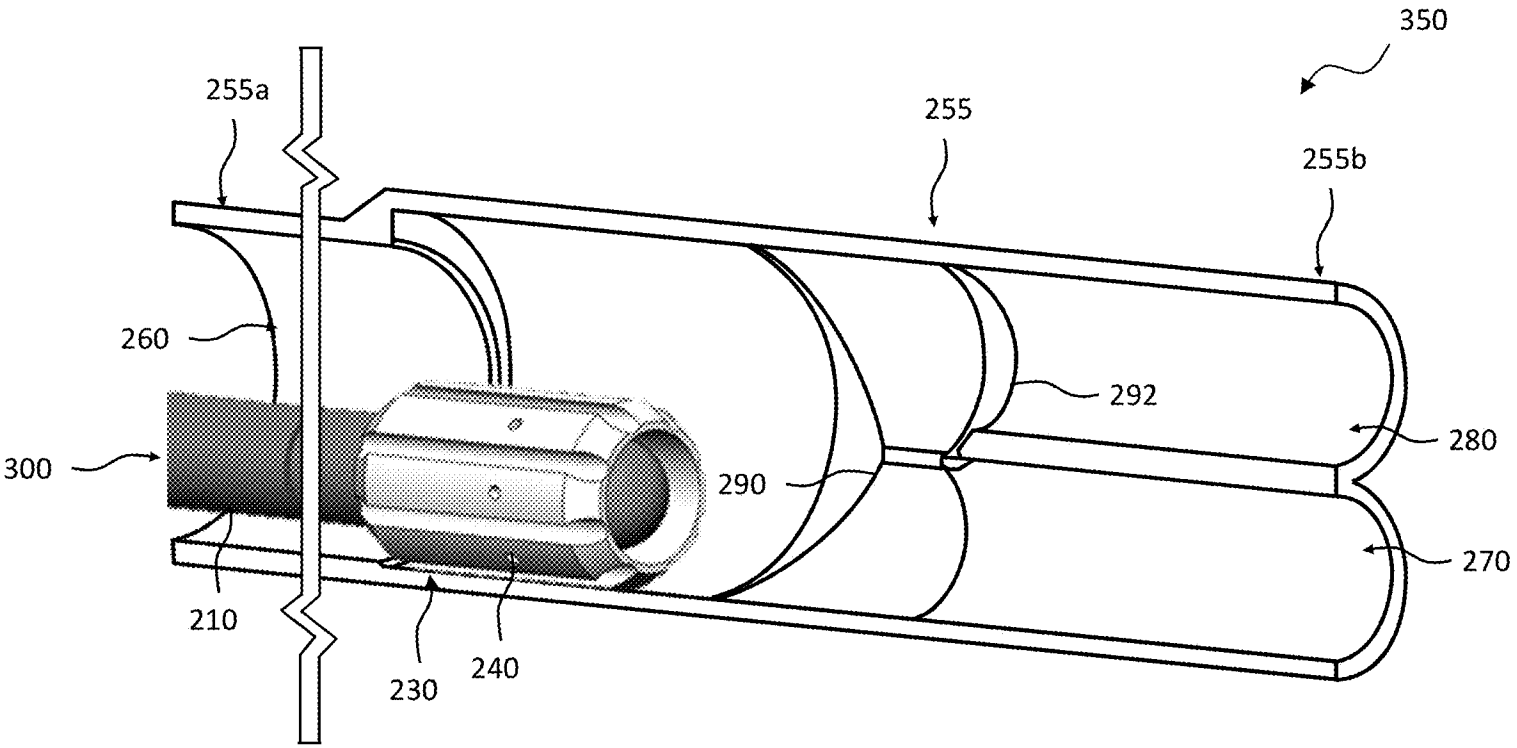
FIGS. 3 through 6 illustrates a method for deploying a downhole tool within a y-block according to one or more embodiments of the disclosure.

Turning to FIG. 2B, illustrated is a cross-section of a perspective view of a y-block 250 designed, manufactured and operated according to one or more embodiments of the disclosure. The y-block 250 includes a housing 255. For example, the housing 255 could be a solid piece of metal having been milled to contain various different bores according to the disclosure. In another embodiment, the housing 255 is a cast metal housing formed with the various different bores according to the disclosure. The housing 255, in accordance with one embodiment, may include a first end 255*a* and a second opposing end 255*b*. The first end 255*a*, in one or more embodiments, is a first uphole end, and the second end 255*b*, in one or more embodiments, is a second downhole end.

The housing 255 may have a length (L), which in the disclosed embodiment is defined by the first end 255*a* and the second opposing end 255*b*. The length (L) may vary greatly and remain within the scope of the disclosure. In one embodiment, however, the length (L) ranges from about 0.5 meters to about 4 meters. In yet another embodiment, the length (L) ranges from about 1.5 meters to about 2.0 meters, and in yet another embodiment the length (L) is approximately 1.8 meters (e.g., approximately 72 inches).

The y-block 250, in one or more embodiments, includes a single first bore 260 extending into the housing 255 from the first end 255*a*. In the disclosed embodiment, the single first bore 260 defines a first centerline 265. The y-block 250, in one or more embodiments, further includes a second bore 270 and a third bore 280 extending into the housing 255. In the illustrated embodiment the second bore 270 and the third bore 280 branch off from the single first bore 260 at a point between the first end 255*a* and the second opposing end 255*b*. In accordance with one embodiment of the disclosure, the second bore 270 defines a second centerline 275 and the third bore 280 defines a third centerline 285. The second centerline 275 and the third centerline 285 may have various different configurations relative to one another. In one embodiment the second centerline 275 and the third centerline 285 are parallel with one another. In another embodiment, the second centerline 275 and the third centerline 285 are angled relative to one another, and for example relative to the first centerline 265.

The single first bore 260, the second bore 270 and the third bore 280 may have different diameters and remain with the scope of the disclosure. In one embodiment, the single first bore 260 has a diameter ($d_1$). In one embodiment, the single first bore 260 has a diameter ($d_1$). The diameter ($d_1$) may range greatly, but in one or more embodiments the diameter ($d_1$) ranges from about 2.5 cm to about 60.1 cm (e.g., from about 1 inches to about 24 inches). The diameter ($d_1$), in one or more embodiments, ranges from about 7.6 cm to about 40.6 cm (e.g., from about 3 inches to about 16 inches). In yet another embodiment, the diameter ($d_1$) may range from about 15.2 cm to about 30.5 cm (e.g., from about 6 inches to about 12 inches). In yet another embodiment, the diameter ($d_1$) may range from about 17.8 cm to about 25.4 cm (e.g., from about 7 inches to about 10 inches), and more specifically in one embodiment a value of about 21.6 cm (e.g., about 8.5 inches).

In one embodiment, the second bore 270 has a diameter ($d_2$). The diameter ($d_2$) may range greatly, but in one or more embodiments the diameter ($d_2$) ranges from about 0.64 cm to about 50.8 cm (e.g., from about ¼ inches to about 20 inches). The diameter ($d_2$), in one or more embodiments, ranges from about 2.5 cm to about 17.8 cm (e.g., from about 1 inches to about 7 inches). In yet another embodiment, the diameter ($d_2$) may range from about 6.4 cm to about 12.7 cm (e.g., from about 2.5 inches to about 5 inches). In yet another embodiment, the diameter ($d_2$) may range from about 7.6 cm to about 10.2 cm (e.g., from about 3 inches to about 4 inches), and more specifically in one embodiment a value of about 8.9 cm (e.g., about 3.5 inches).

In one embodiment, the third bore 280 has a diameter ($d_3$). The diameter ($d_3$) may range greatly, but in one or more embodiments the diameter ($d_3$) ranges from about 0.64 cm to about 50.8 cm (e.g., from about ¼ inches to about 20 inches). The diameter ($d_3$), in one or more other embodiments, ranges from about 2.5 cm to about 17.8 cm (e.g., from about 1 inches to about 7 inches). In yet another embodiment, the diameter ($d_3$) may range from about 6.4 cm to about 12.7 cm (e.g., from about 2.5 inches to about 5 inches). In yet another embodiment, the diameter ($d_3$) may range from about 7.6 cm to about 10.2 cm (e.g., from about 3 inches to about 4 inches), and more specifically in one embodiment a value of about 8.9 cm (e.g., about 3.5 inches). Further to these embodiments, in certain circumstances the diameter ($d_2$) is the same as the diameter ($d_3$), and in yet other circumstances the diameter ($d_2$) is greater than the diameter ($d_3$).

The y-block 250 illustrated in FIG. 2B additionally includes a deflector ramp 290 position at a junction between the single first bore 260 and the second and third separate bores 270, 280. In this embodiment, the deflector ramp 290 is configured to urge a downhole tool toward the third separate bore 280. The deflector ramp 290, in one or more embodiments, has a deflection angle (θ). The deflection angle (θ) may vary greatly and remain within the scope of the disclosure, but in certain embodiments the deflection angle (θ) is at least 30 degrees. In yet another embodiment, the deflection angle (θ) is at least 45 degree. While not clearly illustrated in FIG. 2B, the deflector ramp 290 may be integral to the housing 255, or alternatively may be a deflector ramp insert.

In certain embodiments, an uphole end of the third bore 280 includes a recess feature 292. The recess feature 292, in this embodiment, is configured to engage with a nose of a downhole tool. For example, as the nose of a downhole tool rides up the deflector ramp 290, it would engage with the recess feature 292. In certain embodiments, the recess feature 292 includes a sealing member 294 positioned in the recess feature 292. In regard to this embodiment, the sealing member 294 (e.g., O-ring) would provide a fluid tight seal between the housing 255 and the downhole tool (not shown).

Turning briefly to FIG. 2C, illustrated is a cross-sectional view of the y-block 250 illustrated in FIG. 2B, for example taken through the line 2C-2C. FIG. 2C illustrates the second bore 270 and the third bore 280, as well as the deflector ramp 290 and the recess feature 292 located in the third bore 280. FIG. 2C additionally illustrates the first bore diameter ($d_1$), the second bore diameter ($d_2$) and the third bore diameter ($d_3$).

Figure 4:
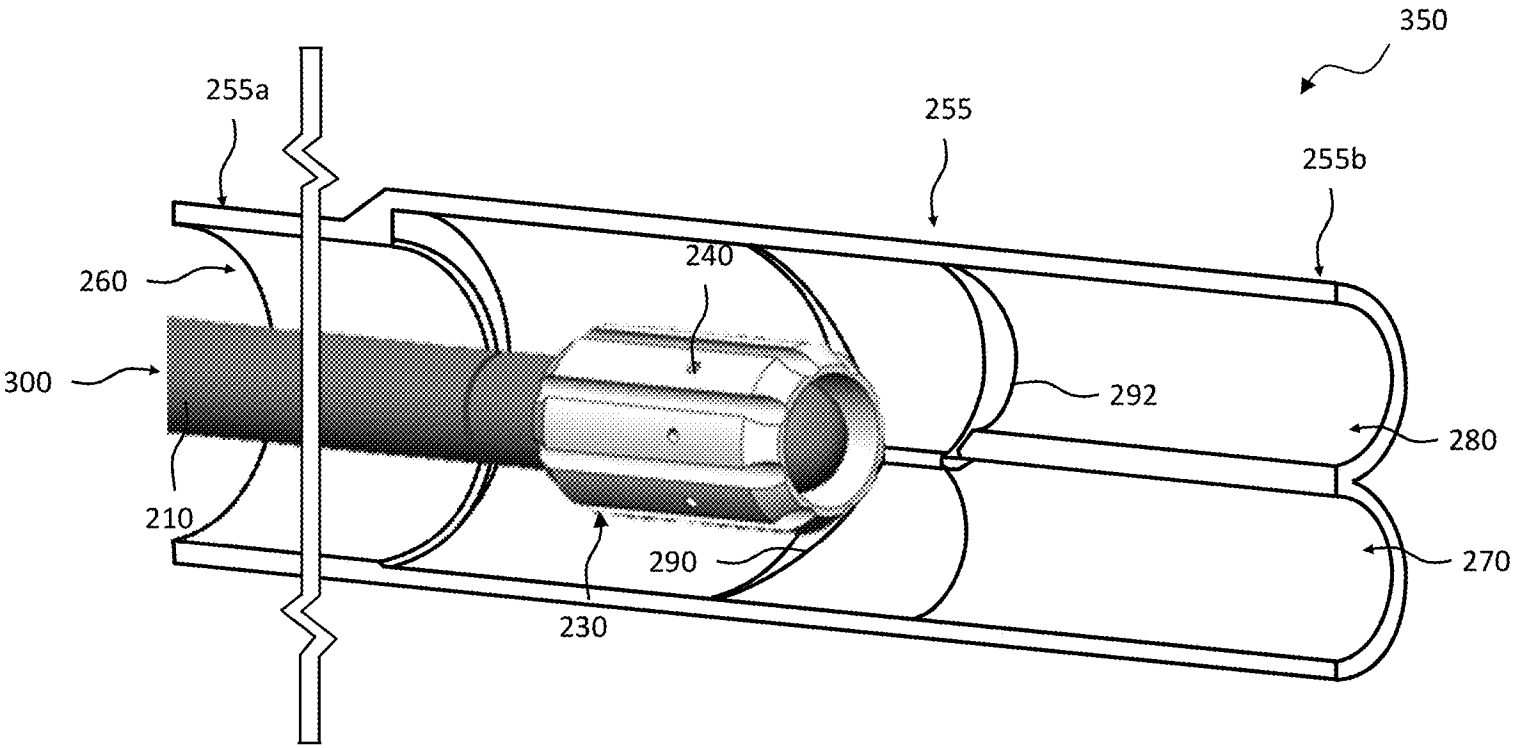

Turning now to FIGS. 3 through 6, illustrated is a method for deploying a downhole tool 300 within a y-block 350 according to one or more embodiments of the disclosure. The downhole tool 300 is similar in many respects to the downhole tool 200 illustrated above with regard to FIG. 2A. The y-block 350 is similar in many respects to the y-block 250 illustrated above with regard to FIGS. 2B and 2C. Accordingly, like reference number have been used to indicate similar, if not identical, features. With initial reference to FIG. 3, the downhole tool 300 is approaching the deflector ramp 290 in the y-block 350. At this stage, the shroud 230 is fixed relative to the BHA 210 using the one or more shear features 240. The one or more shear features 240, in one or more embodiments, collectively have a minimum shear force of at least about 200 pounds. In yet another embodiment, the one or more shear features 240 collectively have a shear force ranging from about 500 pounds to about 10,000 pounds Turning to FIG. 4, illustrated is the downhole tool 300 riding up the deflector ramp 290. Specifically, the shroud 230 has a greater diameter than the second bore 270, and thus the shroud 230 causes the downhole tool 300 to ride up the deflector ramp 290. Again, at this stage the shroud 230 remains fixed relative to the BHA 210 using the one or more shear features 240.

Figure 5:
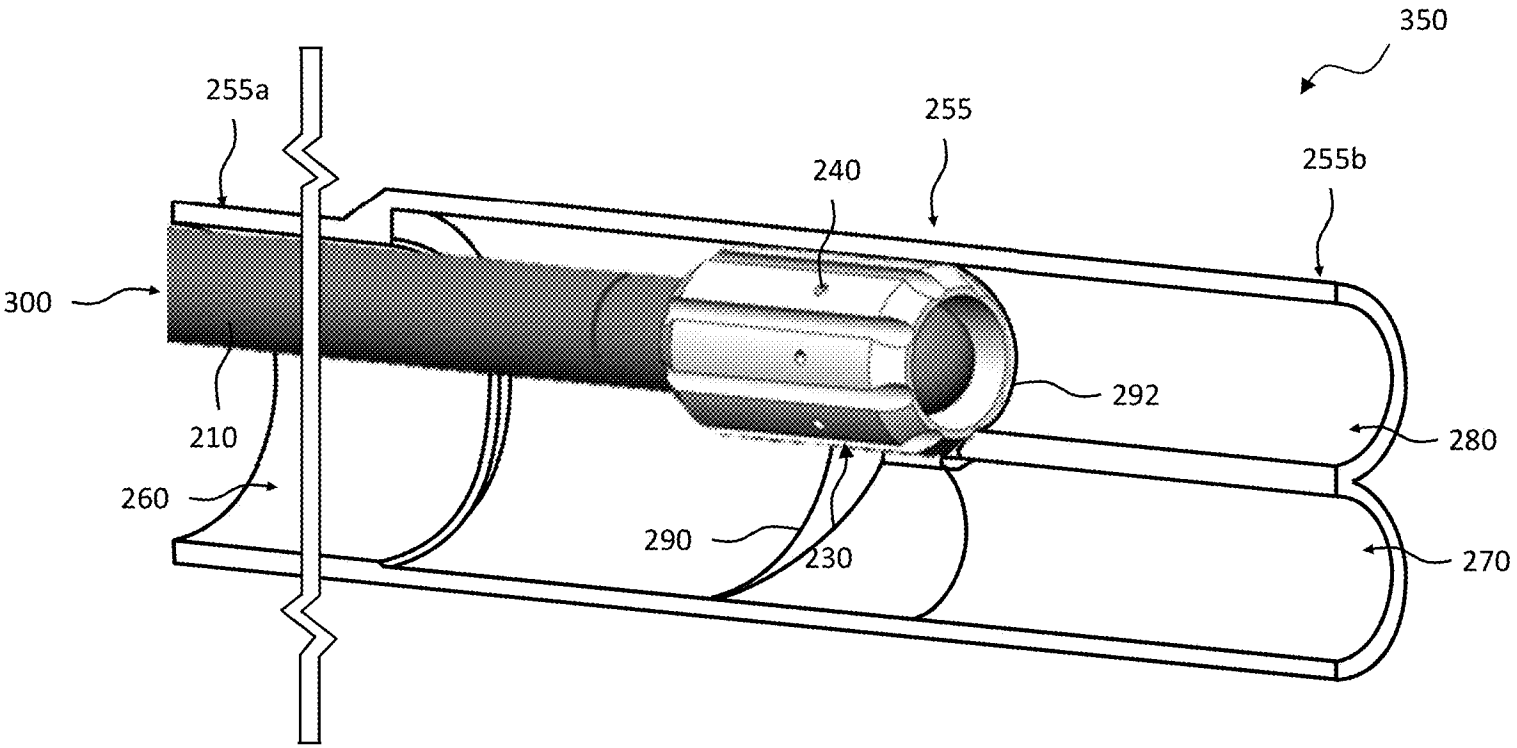

Turning to FIG. 5, illustrated is the downhole tool 300 after pushing the BHA 210 further downhole, causing the downhole end of the shroud 230 to ride up the deflector ramp 290 and engage with the third bore 280. In the illustrated embodiment, the shroud 230 engages with the recess feature 292 in the third bore 280. Again, at this stage the shroud 230 remains fixed relative to the BHA 210 using the one or more shear features 240.

Figure 6:
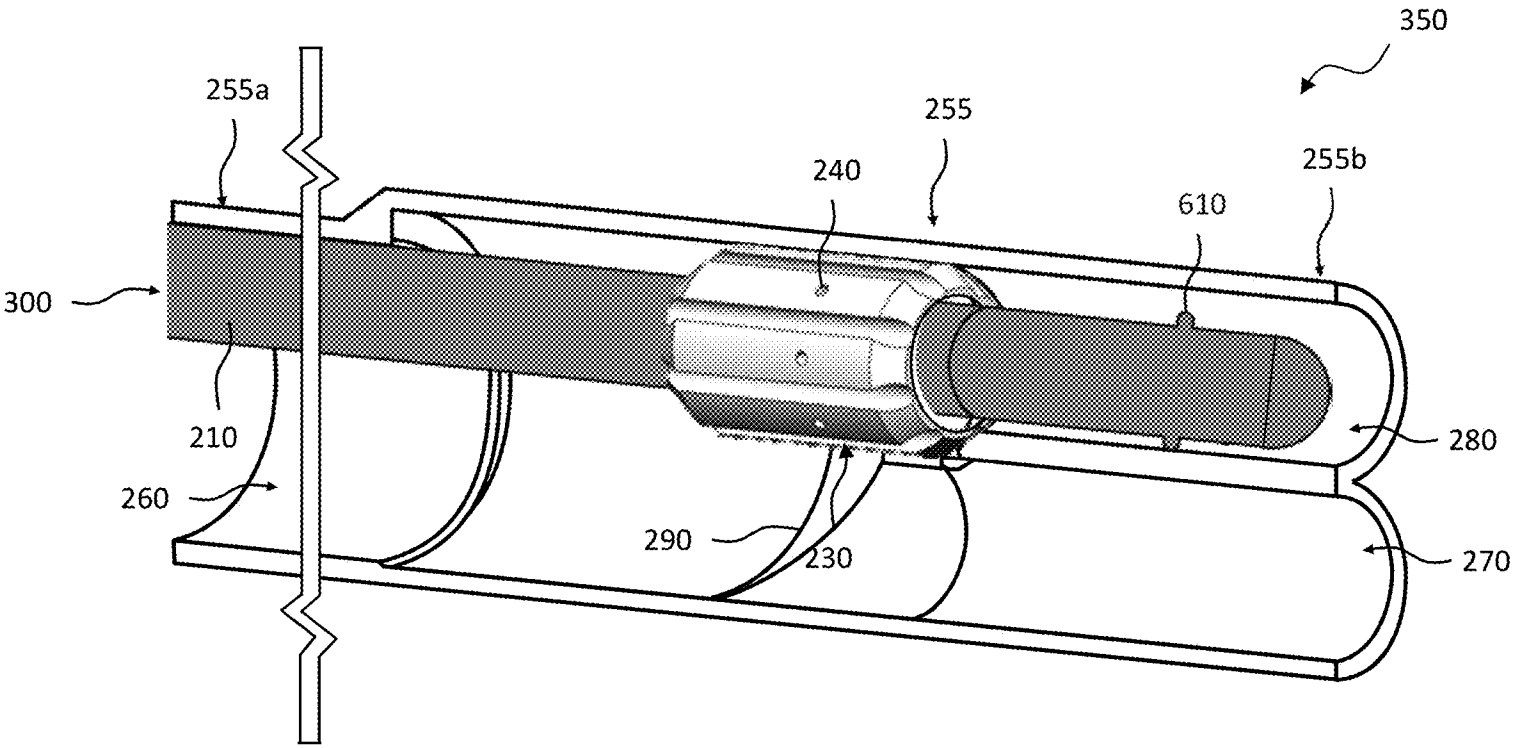

Turning to FIG. 6, illustrated is the downhole tool 300 after putting additional weight down on the BHA 210 while the shroud 230 is engaged with the third bore 280. In this embodiment, the additional weight shears the shear features 240 and causing the BHA 210 to enter the lateral wellbore. FIG. 6 additionally illustrates the aforementioned one or more protrusions 610 extending radially outward from the BHA 210. As discussed above, the one or more protrusions 610 are operable to catch one or more profiles extending from an inner surface of the shroud 230, for example as the BHA 210 and shroud 230 are being withdrawn uphole.

Figure 7:
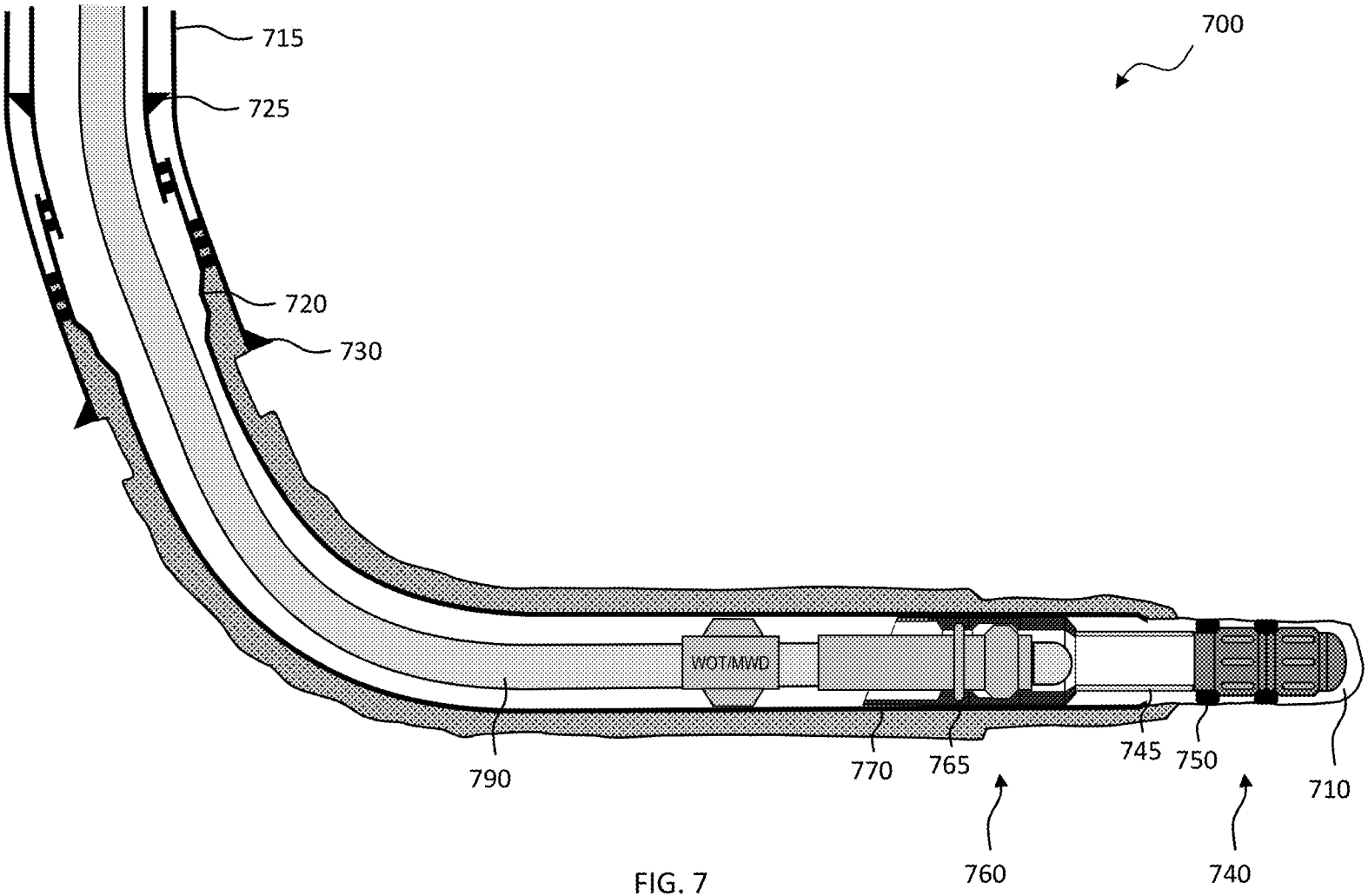
FIGS. 7 through 19 illustrate a method for forming, fracturing and/or producing from a well system.

Turning now to FIGS. 7 through 19, illustrated is a method for forming, intervening, fracturing and/or producing from a well system 700. FIG. 7 is a schematic of the well system 700 at the initial stages of formation. A main wellbore 710 may be drilled, for example by a rotary steerable system at the end of a drill string and may extend from a well origin (not shown), such as the earth's surface or a sea bottom. The main wellbore 710 may be lined by one or more casings 715, 720, each of which may be terminated by a shoe 725, 730.

The well system 700 of FIG. 7 additionally includes a main wellbore completion 740 positioned in the main wellbore 710. The main wellbore completion 740 may, in certain embodiments, include a main wellbore liner 745 (e.g., with frac sleeves in one embodiment), as well as one or more packers 750 (e.g., swell packers in one embodiment). The main wellbore liner 745 and the one or more packer 750 may, in certain embodiments, be run on an anchor system 760. The anchor system 760, in one embodiment, includes a collet profile 765 for engaging with the running tool 790, as well as a muleshoe 770 (e.g., slotted alignment muleshoe). A standard workstring orientation tool (WOT) and measurement while drilling (MWD) tool may be coupled to the running tool 790, and thus be used to orient the anchor system 760.

Figure 8:
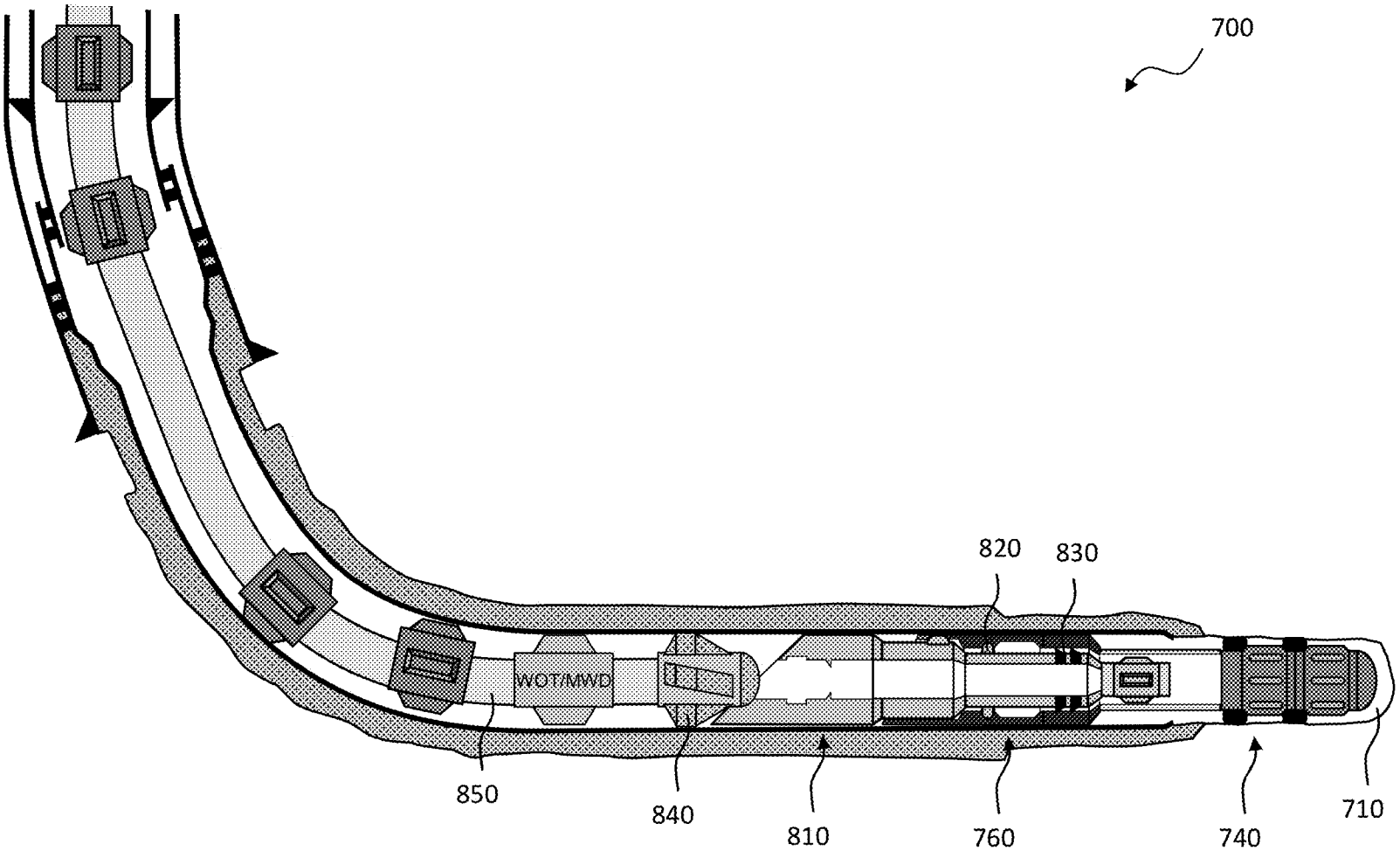

Turning to FIG. 8, illustrated is the well system 700 of FIG. 7 after positioning a whipstock assembly 810 downhole at a location where a lateral wellbore is to be formed. The whipstock assembly 810 includes a collet 820 for engaging the collet profile 765 in the anchor system 760. The whipstock assembly 810 additionally includes one or more seals 830 (e.g., a wiper set in one embodiment) to seal the whipstock assembly 810 with the main wellbore completion 740. In certain embodiments, such as that shown in FIG. 8, the whipstock assembly 810 is made up with a lead mill 840, for example using a shear bolt, and then run in hole on a drill string 850. The WOT/MWD tool may be employed to confirm the appropriate orientation of the whipstock assembly 810.

Figure 9:
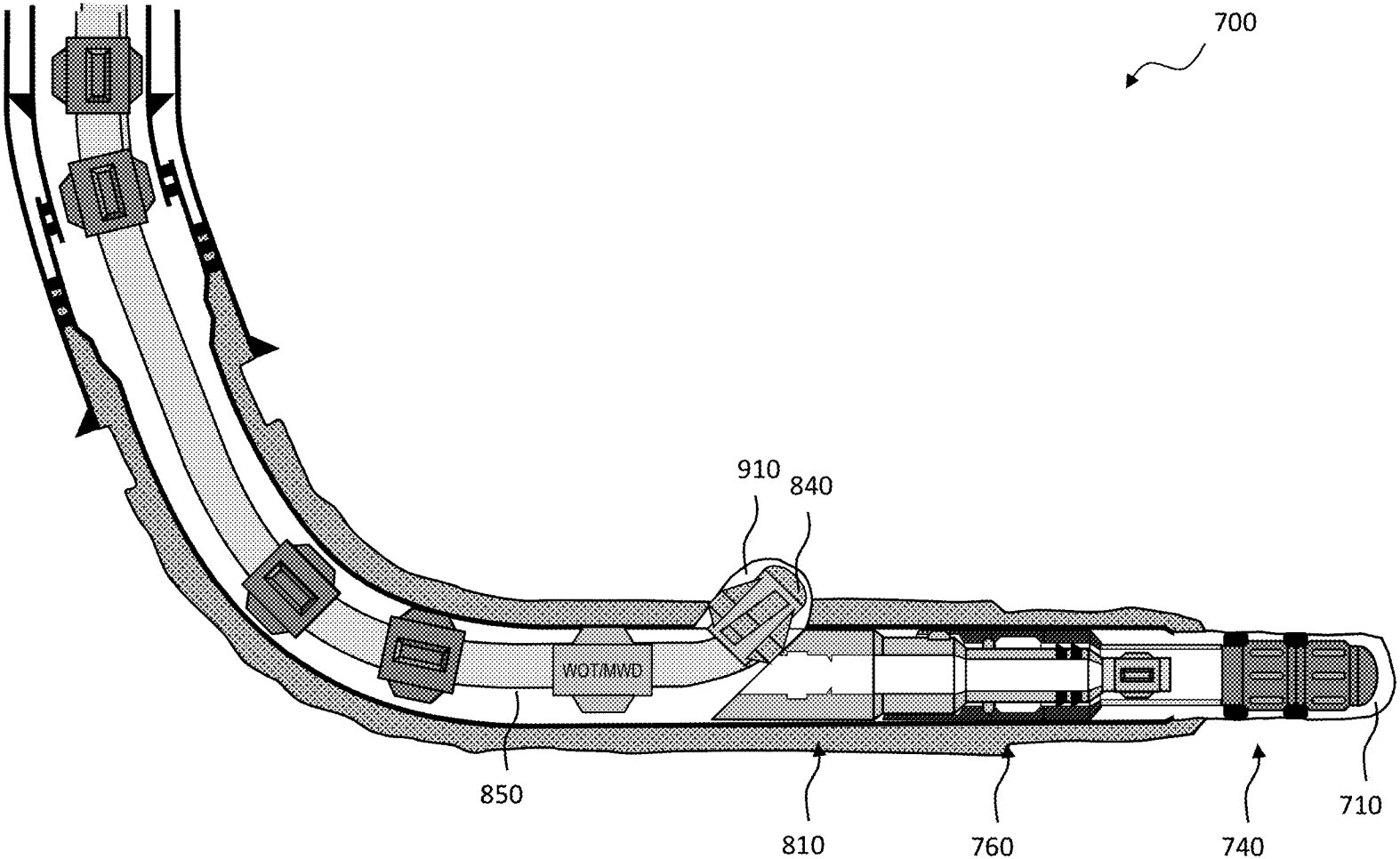

Turning to FIG. 9, illustrated is the well system 700 of FIG. 8 after setting down weight to shear the shear bolt between the lead mill 840 and the whipstock assembly 810, and then milling an initial window pocket 910. In certain embodiments, the initial window pocket 910 is between 1.5 m and 3.0 m long, and in certain other embodiments about 2.5 m long, and extends through the casing 720. Thereafter, a circulate and clean process could occur, and then the drill string 850 and lead mill 840 may be pulled out of hole.

Figure 10:
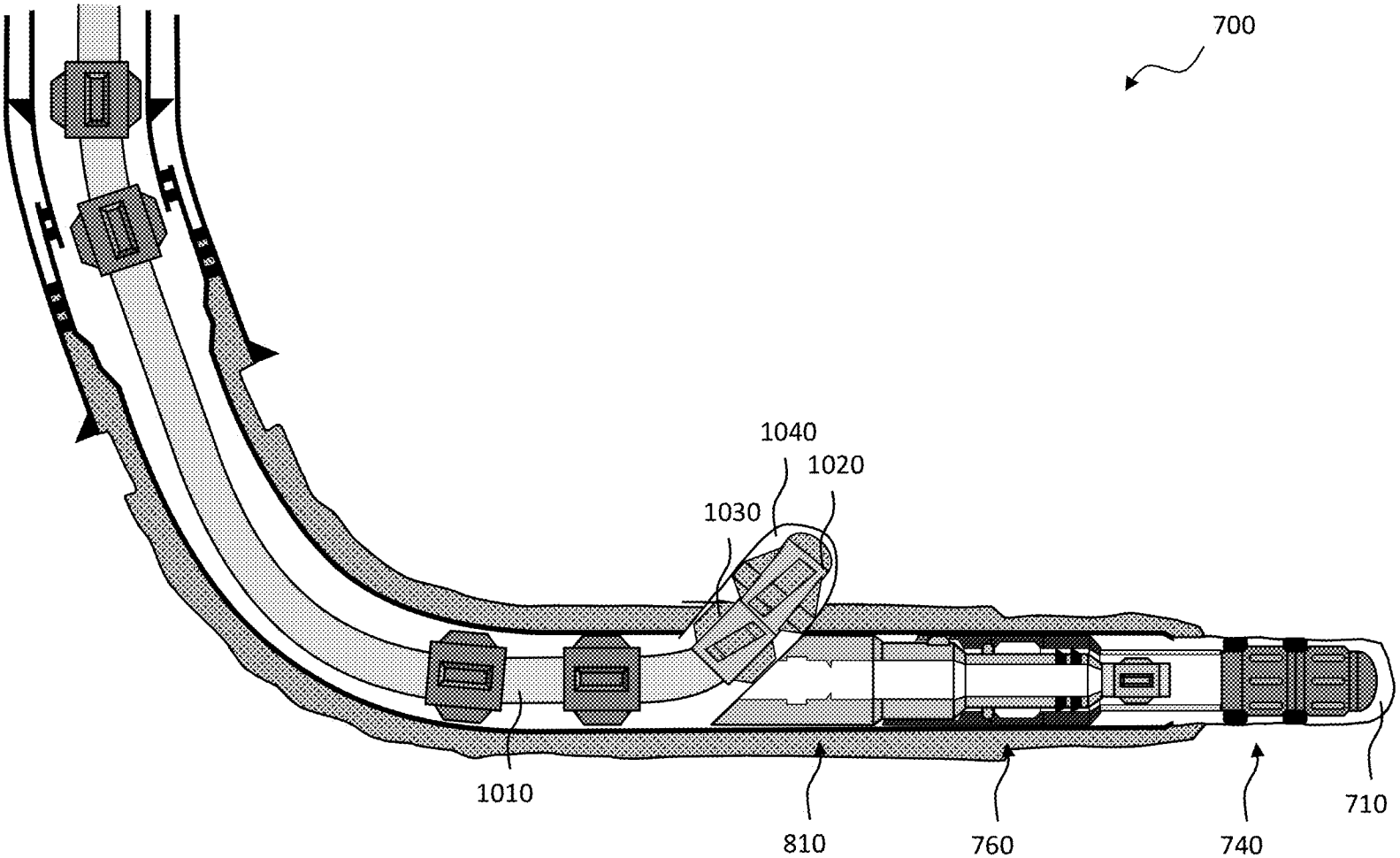

Turning to FIG. 10, illustrated is the well system 700 of FIG. 9 after running a lead mill 1020 and watermelon mill 1030 downhole on a drill string 1010. In the embodiments shown in FIG. 10, the drill string 1010, lead mill 1020 and watermelon mill 1030 drill a full window pocket 1040 in the formation. In certain embodiments, the full window pocket 1040 is between 6 m and 10 m long, and in certain other embodiments about 8.5 m long. Thereafter, a circulate and clean process could occur, and then the drill string 1010, lead mill 1020 and watermelon mill 1030 may be pulled out of hole.

Figure 11:
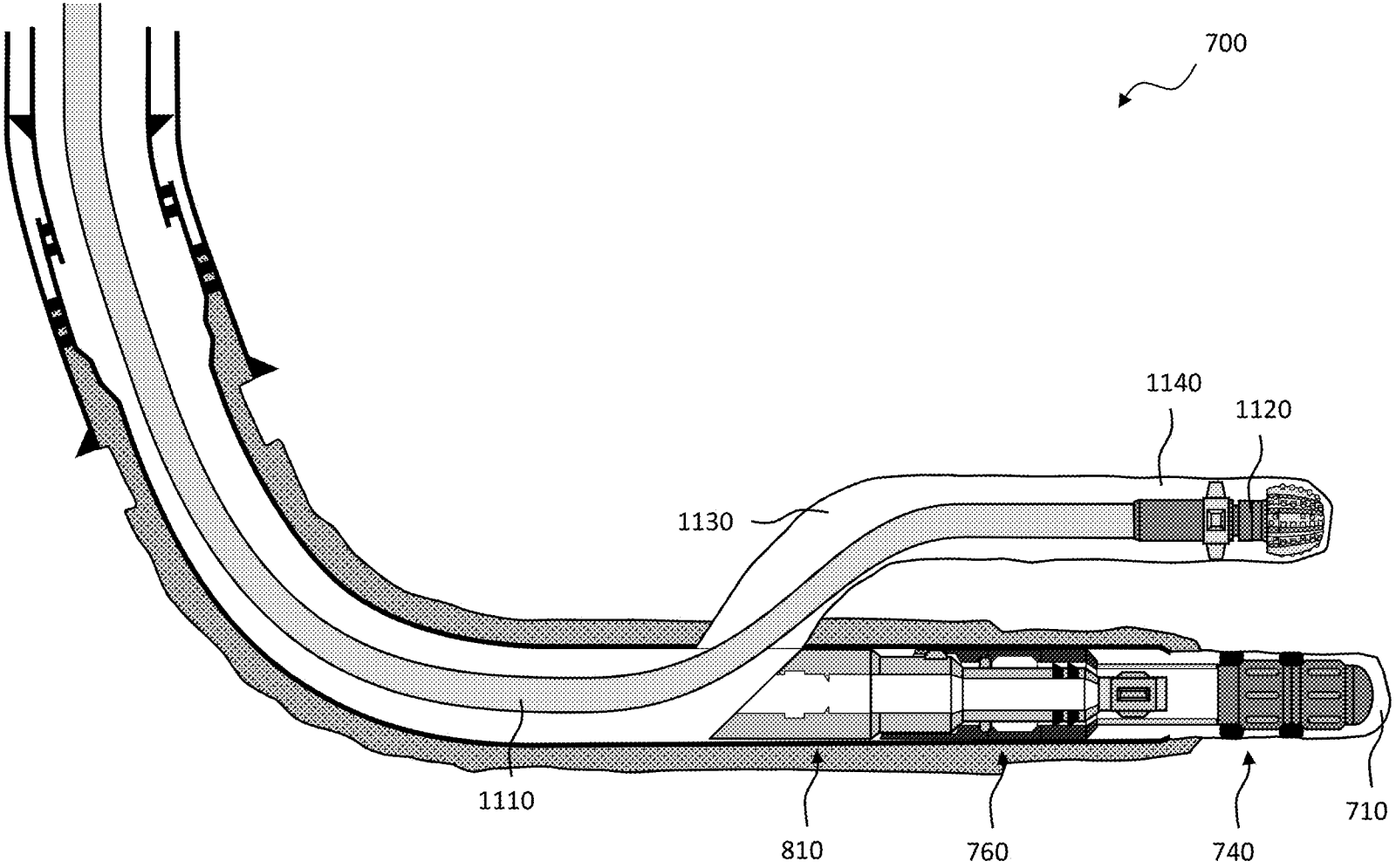

Turning to FIG. 11, illustrated is the well system 700 of FIG. 10 after running in hole a drill string 1110 with a rotary steerable assembly 1120, drilling a tangent 1130 following an inclination of the whipstock assembly 810, and then continuing to drill the lateral wellbore 1140 to depth. Thereafter, the drill string 1110 and rotary steerable assembly 1120 may be pulled out of hole.

Figure 12:
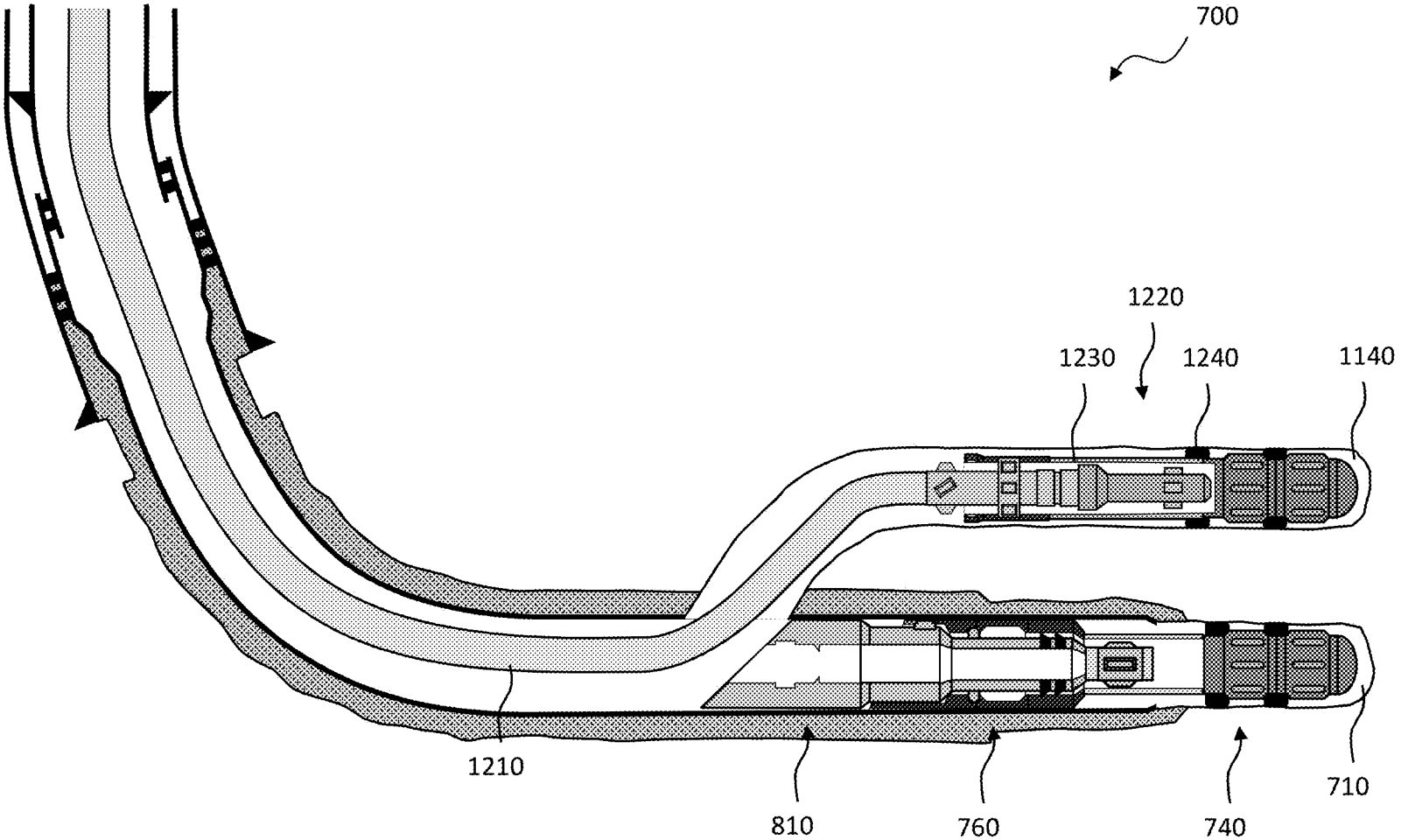

Turning to FIG. 12, illustrated is the well system 700 of FIG. 11 after employing an inner string 1210 to position a lateral wellbore completion 1220 in the lateral wellbore 1140. The lateral wellbore completion 1220 may, in certain embodiments, include a lateral wellbore liner 1230 (e.g., with frac sleeves in one embodiment), as well as one or more packers 1240 (e.g., swell packers in one embodiment). Thereafter, the inner string 1210 may be pulled into the main wellbore 710 for retrieval of the whipstock assembly 810.

Figure 13:
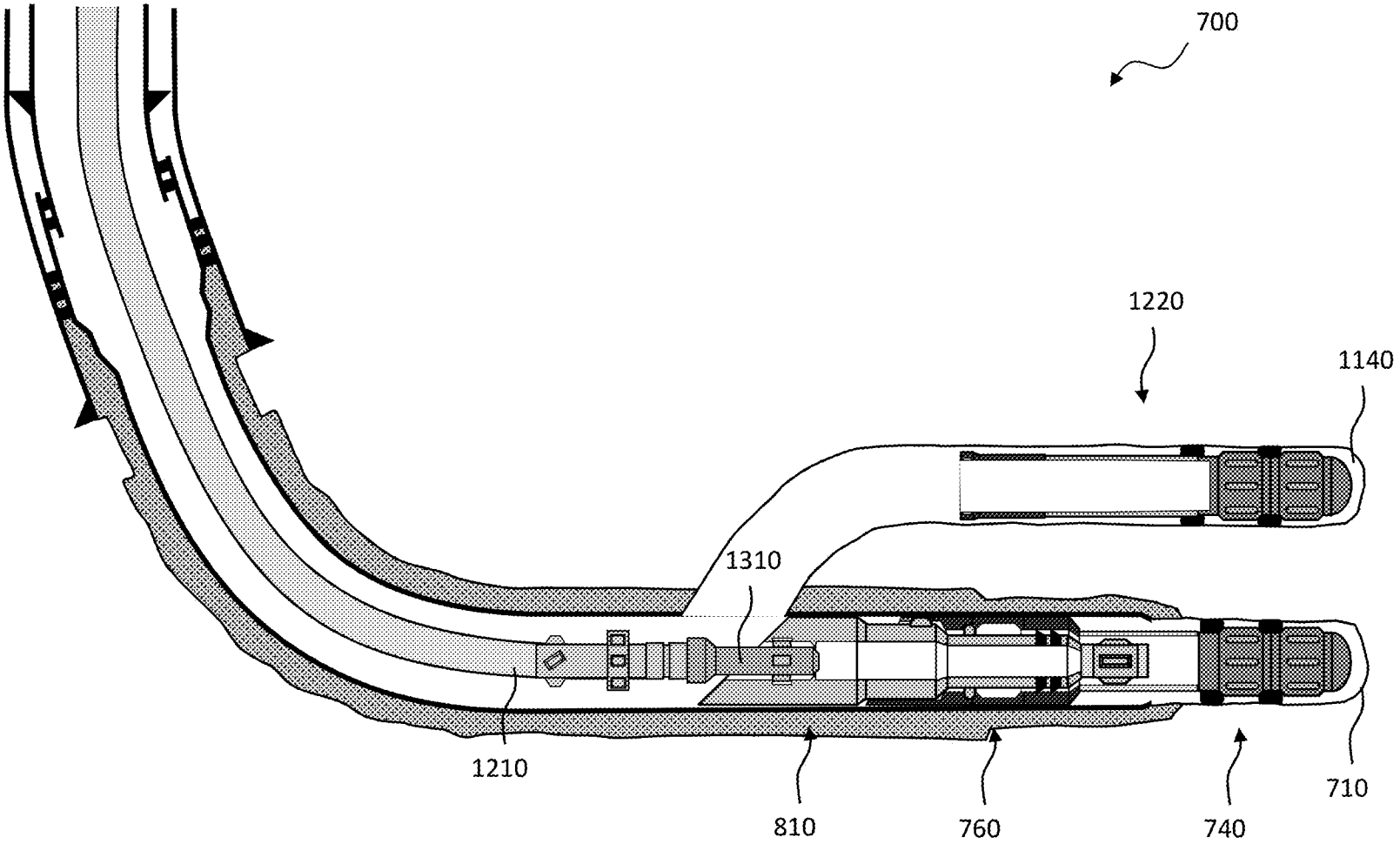

Turning to FIG. 13, illustrated is the well system 700 of FIG. 12 after latching a whipstock retrieval tool 1310 of the inner string 1210 with a profile in the whipstock assembly 810. The whipstock assembly 810 may then be pulled free from the anchor system 760, and then pulled out of hole. What results are the main wellbore completion 740 in the main wellbore 710, and the lateral wellbore completion 1220 in the lateral wellbore 1140.

Figure 14:
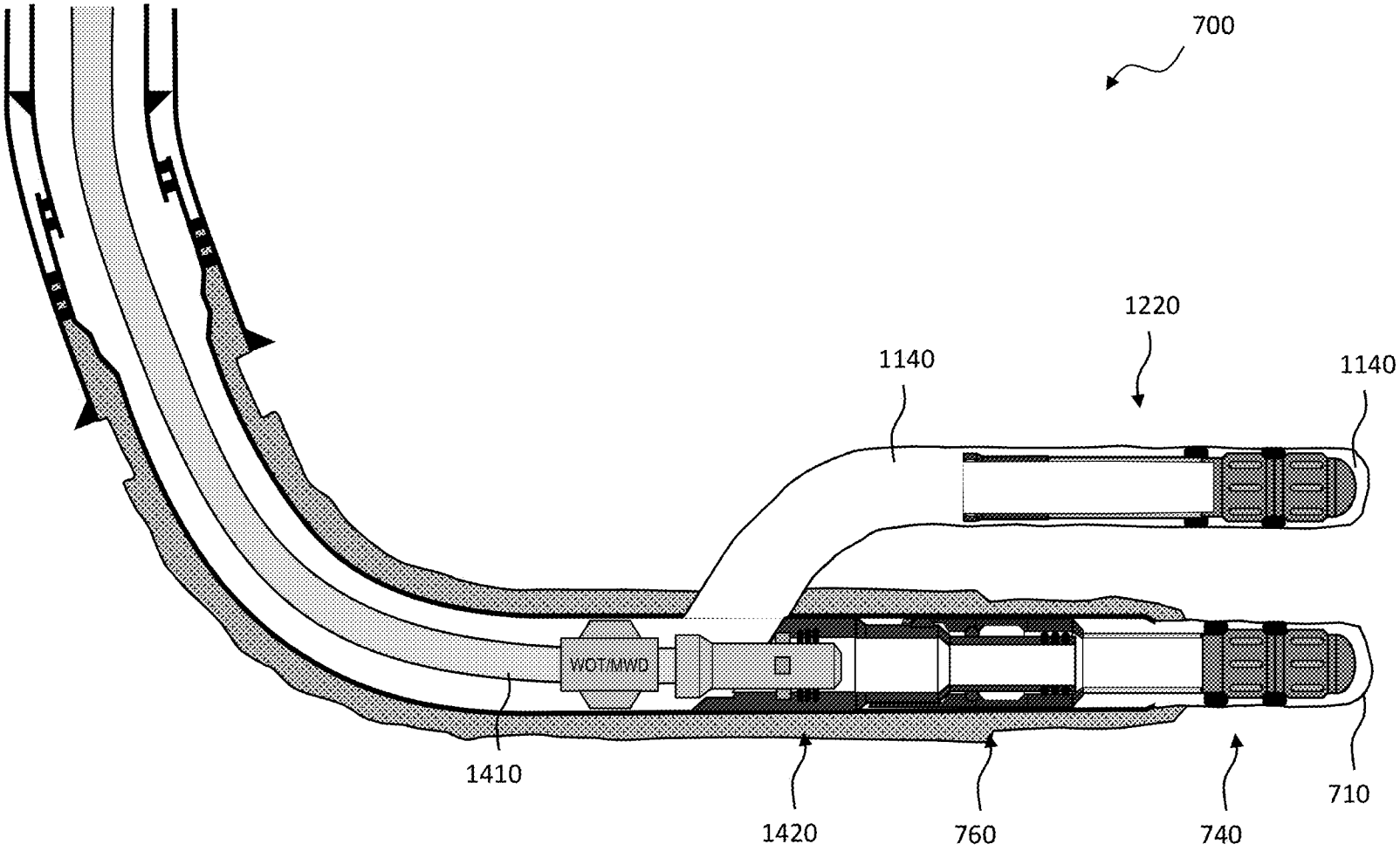

Turning to FIG. 14, illustrated is the well system 700 of FIG. 13 after employing a running tool 1410 to install a deflector assembly 1420 proximate a junction between the main wellbore 710 and the lateral wellbore 1140. The deflector assembly 1420 may be appropriately oriented using the WOT/MWD tool. The running tool 1410 may then be pulled out of hole.

Figure 15:
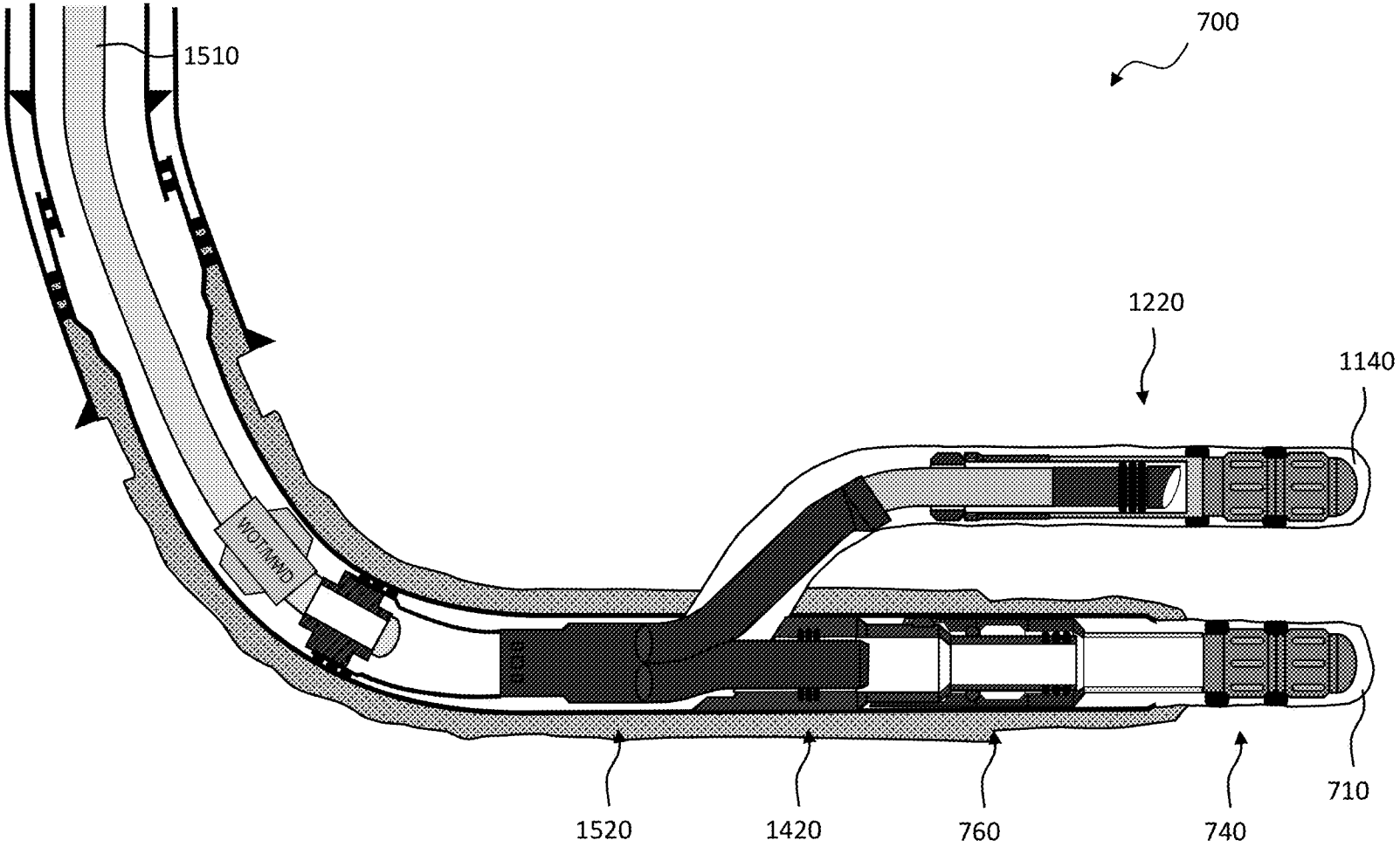

Turning to FIG. 15, illustrated is the well system 700 of FIG. 14 after employing a running tool 1510 to place a multilateral junction 1520 proximate an intersection between the main wellbore 710 and the lateral wellbore 1410. In accordance with one embodiment, the multilateral junction 1520 would include a y-block designed, manufactured, and operated according to one or more embodiments of the disclosure. In the illustrated embodiment, the multilateral junction 1520 includes a y-block similar to the y-block 250 illustrated with respect to FIGS. 2B and 2C.

Figure 16:
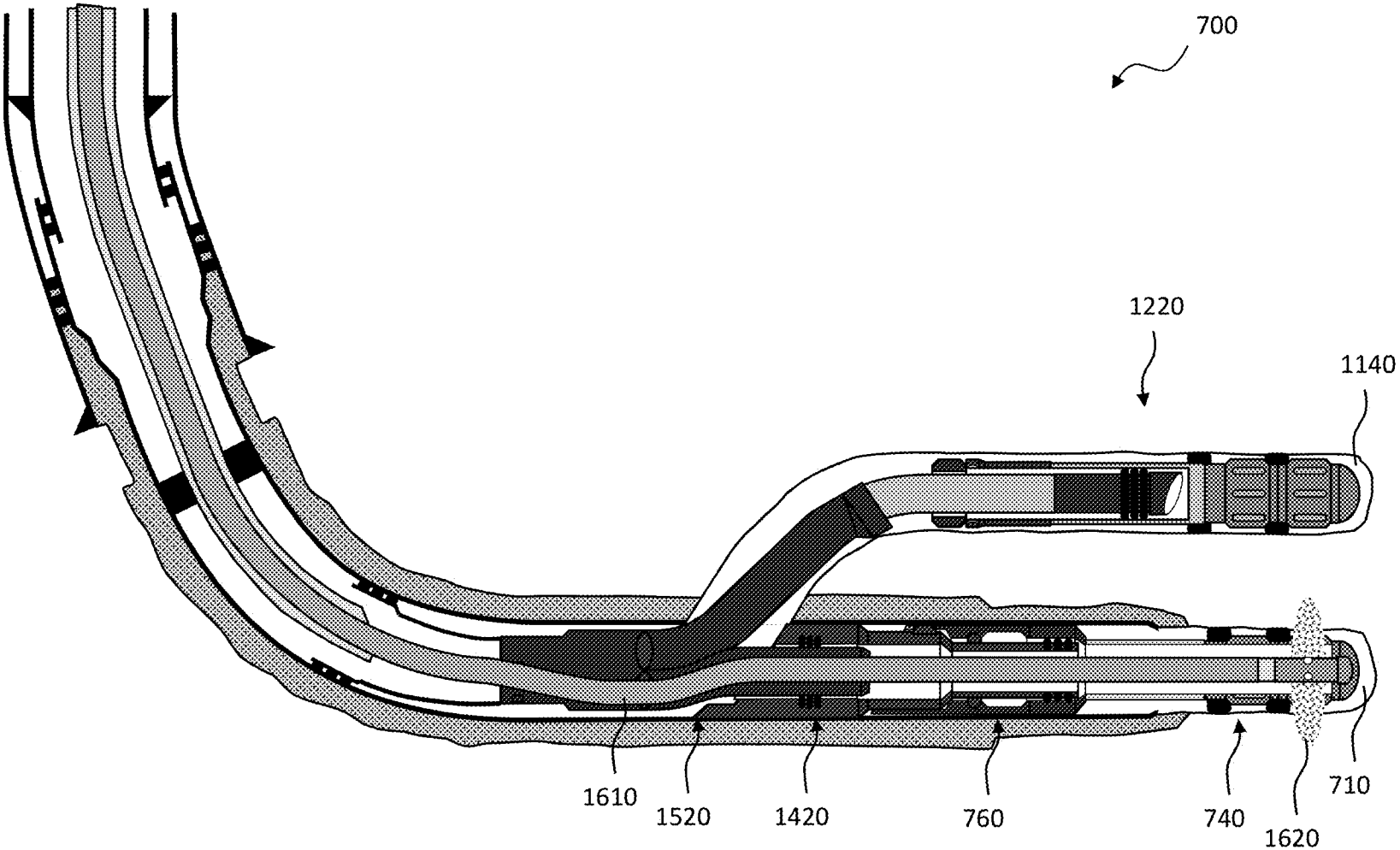

Turning to FIG. 16, illustrated is the well system 700 of FIG. 15 after selectively accessing the main wellbore 710 with a first intervention tool 1610 through the y-block of the multilateral junction 1520. In the illustrated embodiment, the first intervention tool 1610 is a fracturing tool, and more particularly a coiled tubing conveyed fracturing tool. With the first intervention tool 1610 in place, fractures 1620 in the subterranean formation surrounding the main wellbore completion 740 may be formed. Thereafter, the first intervention tool 1610 may be pulled from the main wellbore completion 740.

Figure 17:
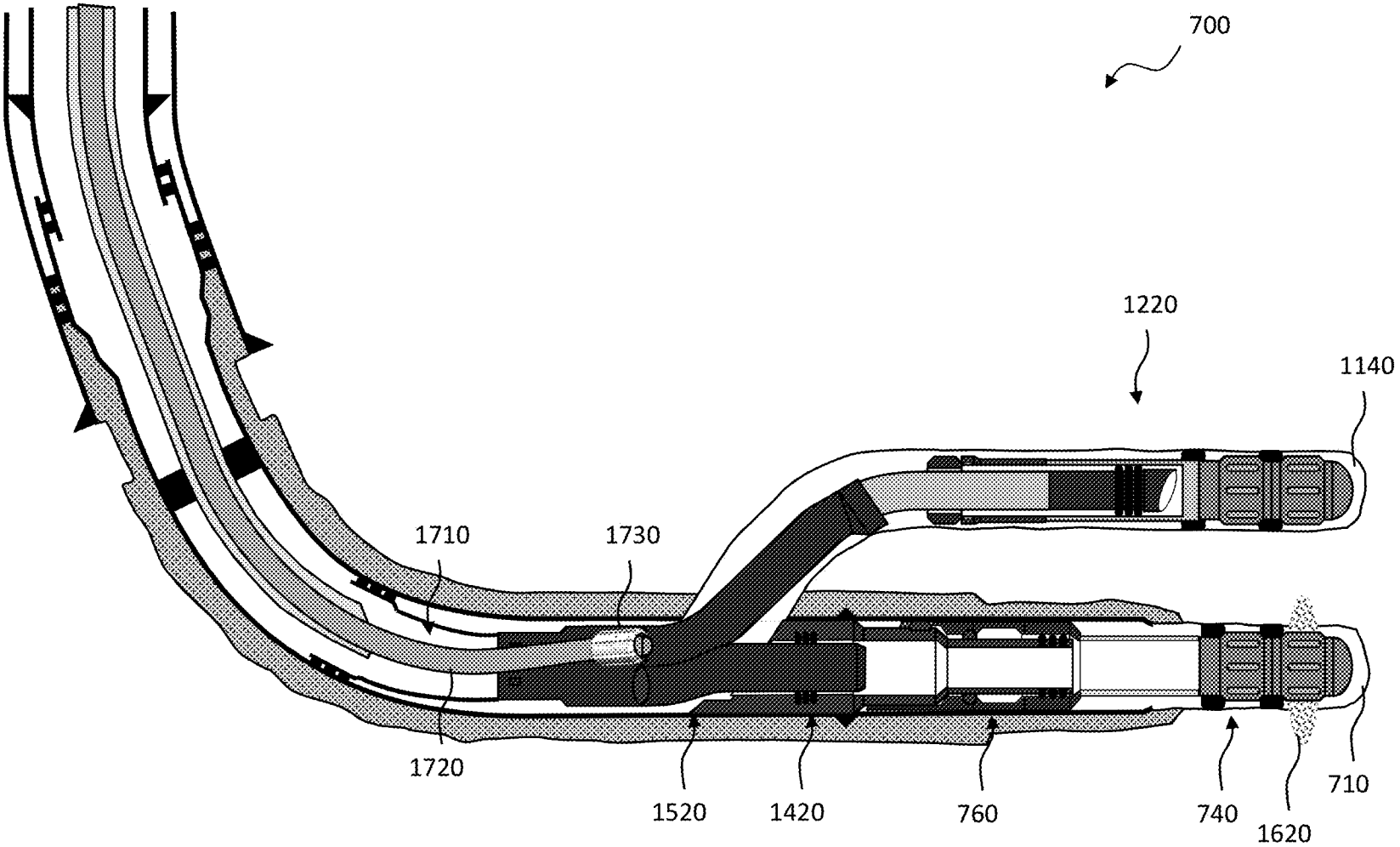

Turning to FIG. 17, illustrated is the well system 700 of FIG. 16 after positioning a downhole tool 1710 within the multilateral junction 1520 including the y-block. The downhole tool 1710, in one or more embodiments, is similar to the downhole tool 200 discussed above with respect to FIGS. 2A and 3 through 6. Accordingly, the downhole tool 1710 includes a BHA 1720, and a shroud 1730 positioned around and proximate the downhole end of the BHA 1720. In the illustrated embodiment, one or more shear features couple the shroud 1730 to the downhole end of the BHA 1720. Furthermore, the shroud 1730 has ridden up the deflector ramp in the y-block, thus causing the shroud 1730 to engage with a recess feature in the lateral bore of the y-block. In the illustrated embodiment, the downhole tool 1710 is a fracturing tool, and more particularly a coiled tubing conveyed fracturing tool.

Figure 18:
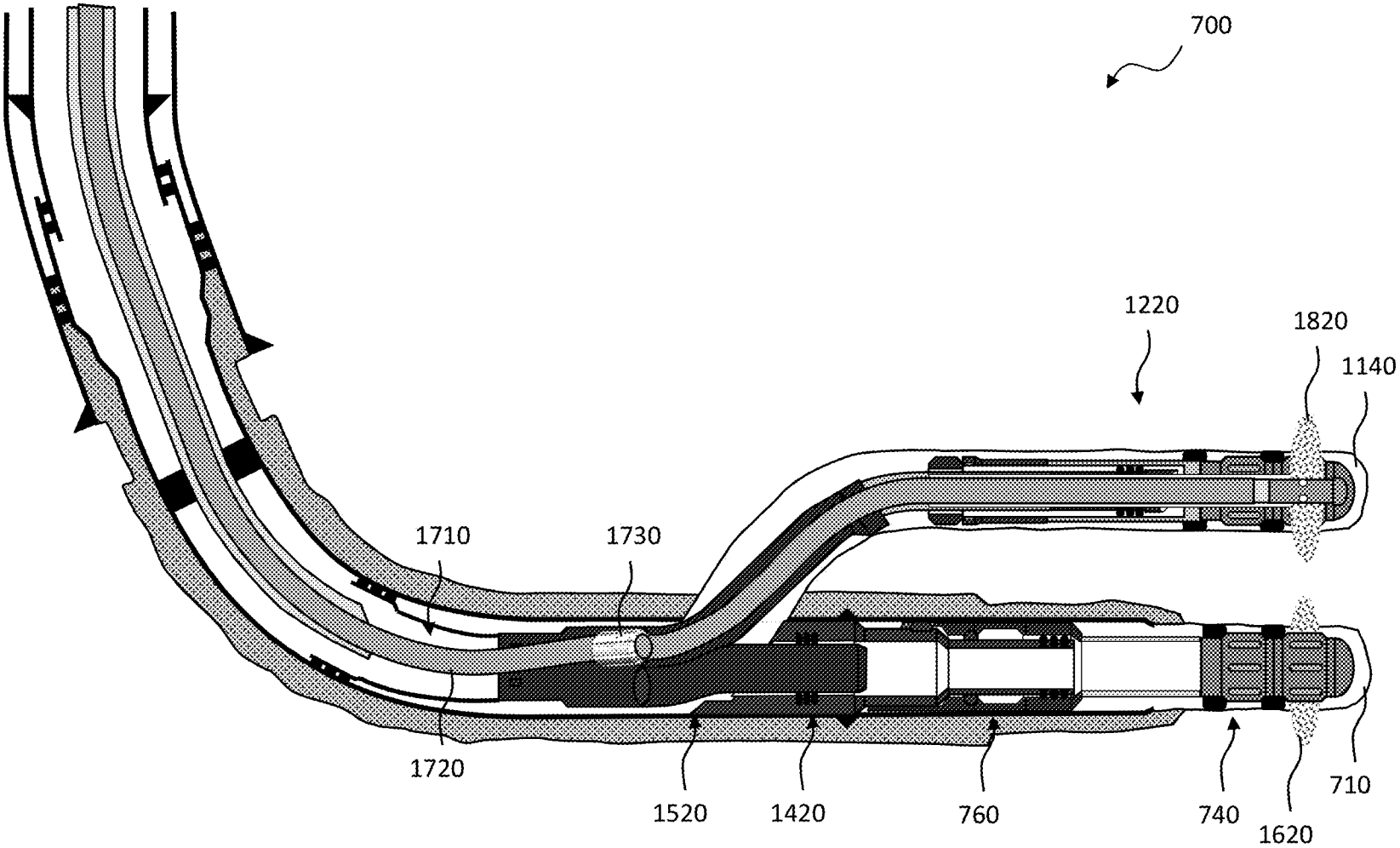

Turning to FIG. 18, illustrated is the well system 700 of FIG. 17 after putting additional weight down on the BHA 1720 while the shroud 1730 is engaged with the lateral bore, the additional weight shearing the shear features and causing the BHA 1720 to enter the lateral wellbore. With the downhole tool 1710 in place, fractures 1820 in the subterranean formation surrounding the lateral wellbore completion 1220 may be formed. In certain embodiments, the first intervention tool 1610 and the downhole tool 1710 are the same intervention tool. Thereafter, the downhole tool 1710 may be pulled from the lateral wellbore completion 1220 and out of the hole. As discussed above, the BHA 1720 may have one or more protrusions extending radially outward therefrom, the one or more protrusions catching one or more profiles extending from an inner surface of the shroud 1730, and thus retrieving the shroud 1730 uphole as the BHA 1720 is pulled uphole.

Figure 19:
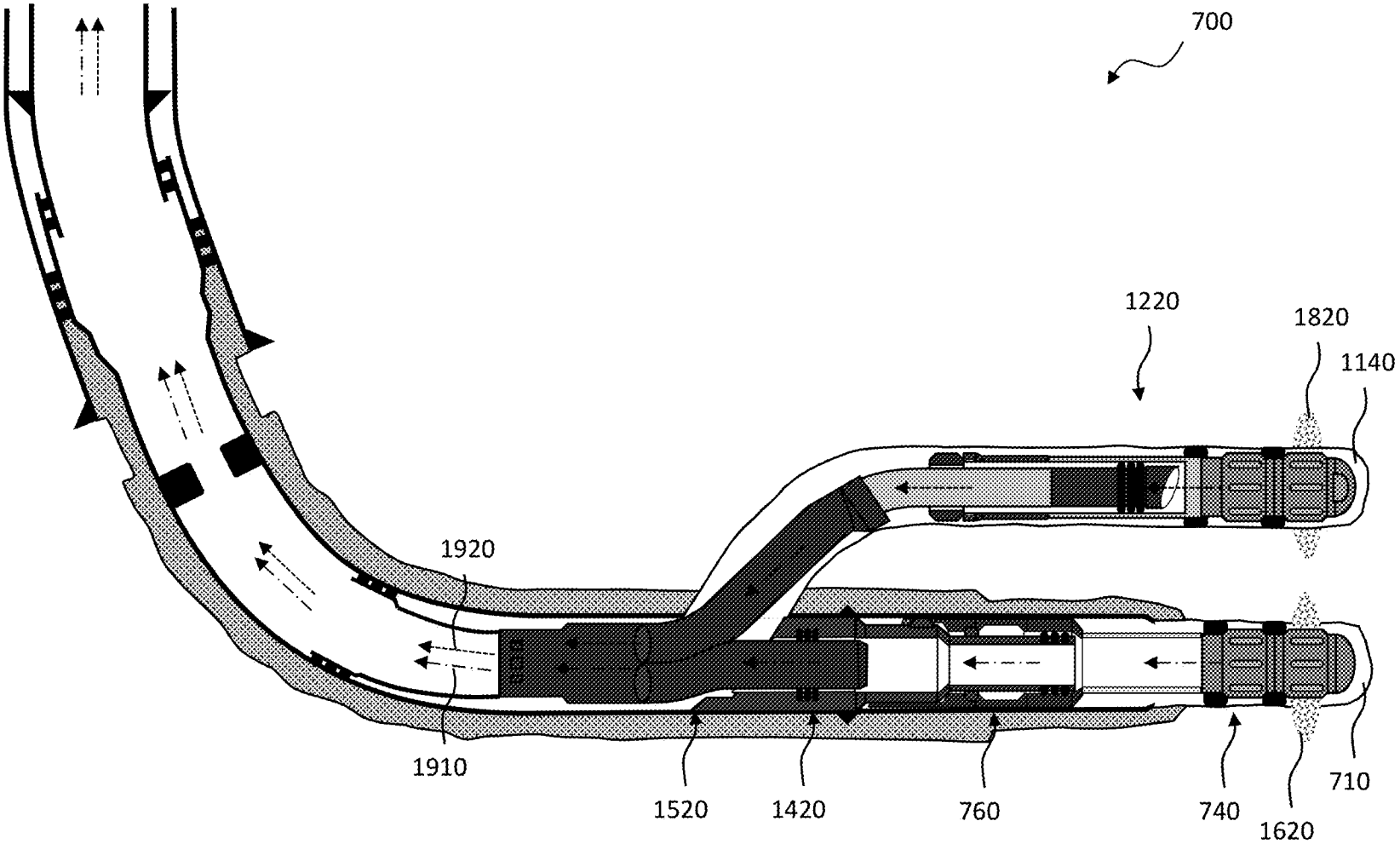

Turning to FIG. 19, illustrated is the well system 700 of FIG. 18 after producing fluids 1910 from the fractures 1620 in the main wellbore 710, and producing fluids 1920 from the fractures 1820 in the lateral wellbore 1140. The producing of the fluids 1910, 1920 occur through the multilateral junction 1520, and more specifically through the y-block design, manufactured and operated according to one or more embodiments of the disclosure.

Aspects disclosed herein include:

A. A downhole tool, the downhole tool including: 1) a bottom hole assembly (BHA) having an uphole end and a downhole end; 2) a shroud positioned around and proximate the downhole end of the BHA, the shroud operable to slide relative to the BHA; and 3) one or more shear features coupling the shroud to the downhole end of the BHA.

B. A y-block, the y-block including: 1) a housing having a first end and a second opposing end; 2) a single first bore extending into the housing from the first end, the single first bore defining a first centerline; 3) second and third separate bores extending into the housing and branching off from the single first bore, the second bore defining a second centerline and the third bore defining a third centerline; and 4) a deflector ramp position at a junction between the single first bore and the second and third separate bores, the deflector ramp configured to urge a downhole tool toward the third separate bore.

C. A well system, the well system including: 1) a main wellbore; 2) a lateral wellbore extending from the main wellbore; 3) a multilateral junction positioned at an intersection of the main wellbore and the lateral wellbore, the multilateral junction including; a) a y-block, the y-block including; i) a housing having a first end and a second opposing end; ii) a single first bore extending into the housing from the first end, the single first bore defining a first centerline; iii) second and third separate bores extending into the housing and branching off from the single first bore, the second bore defining a second centerline and the third bore defining a third centerline; and iv) a deflector ramp position at a junction between the single first bore and the second and third separate bores, the deflector ramp configured to urge a downhole tool toward the third separate bore; b) a mainbore leg coupled to the second bore and extending into the main wellbore; and c) a lateral bore leg coupled to the third bore and extending into the lateral wellbore; and 4) a downhole tool positioned within the y-block, the downhole tool including; a) a bottom hole assembly (BHA) having an uphole end and a downhole end; b) a shroud positioned around the BHA and engaged with the third bore, the shroud operable to slide relative to the BHA.

D. A method for forming a well system, the method including: 1) placing a multilateral junction proximate an intersection between a main wellbore and a lateral wellbore, the multilateral junction including; a) a y-block, the y-block including; i) a housing having a first end and a second opposing end; ii) a single first bore extending into the housing from the first end, the single first bore defining a first centerline; iii) second and third separate bores extending into the housing and branching off from the single first bore, the second bore defining a second centerline and the third bore defining a third centerline; and iv) a deflector ramp position at a junction between the single first bore and the second and third separate bores, the deflector ramp configured to urge a downhole tool toward the third separate bore; b) a mainbore leg coupled to the second bore and extending into the main wellbore; and c) a lateral bore leg coupled to the third bore and extending into the lateral wellbore; 2) positioning a downhole tool within the y-block, the downhole tool including; a) a bottoms hole assembly (BHA) having an uphole end and a downhole end; b) a shroud positioned around and proximate the downhole end of the BHA, the shroud operable to slide relative to the BHA; and c) one or more shear features coupling the shroud to the downhole end of the BHA; 3) pushing the downhole tool further downhole, causing a downhole end of the shroud to ride up the deflector ramp and engage with the third bore; and 4) putting additional weight down on the BHA while the shroud is engaged with the third bore, the additional weight shearing the shear features and causing the BHA to enter the lateral wellbore.

Aspects A, B, C, and D may have one or more of the following additional elements in combination: Element 1: wherein the shroud has a rounded nose proximate a downhole end thereof, the rounded nose configured to engage with a recess feature in a leg of a y-block. Element 2: wherein the shroud has one or more fluid passageways extending along a length ($L_s$) thereof. Element 3: wherein the one or more fluid passageways are one or more flutes extending along the length ($L_s$) of an outer surface thereof. Element 4: wherein three or more shear features couple the shroud to the downhole end of the BHA, the three or more shear features radially positioned equal distance around the shroud. Element 5: wherein the BHA has one or more protrusions extending radially outward therefrom, the one or more protrusions operable to catch one or more profiles extending from an inner surface of the shroud. Element 6: wherein the one or more protrusions are positioned downhole of the one or more profiles, the one or more protrusions operable to catch the one or more profiles when retrieving the BHA uphole. Element 7: wherein the BHA is coupled to coiled tubing. Element 8: wherein the one or more shear features collectively have a minimum shear force of at least about 200 pounds. Element 9: wherein the one or more shear features collectively have a shear force ranging from about 500 pounds to about 10,000 pounds. Element 10: further including a recess feature positioned at an uphole end of the third separate bore, the recess feature configured to engage with a nose of a downhole tool. Element 11: wherein the recess feature provides a metal to metal seal with the downhole tool. Element 12: further including a sealing member positioned in the recess feature, the sealing member providing a fluid tight seal between the housing and the downhole tool. Element 13: wherein the second bore has a diameter ($d_2$) and the third bore has a diameter ($d_3$), and further wherein the diameter ($d_2$) is the same as the diameter ($d_3$). Element 14: wherein the second bore has a diameter ($d_2$) and the third bore has a diameter ($d_3$), and further wherein the diameter ($d_2$) is greater than the diameter ($d_3$). Element 15: wherein the second centerline and the third centerline are parallel with one another. Element 16: wherein the deflector ramp has a deflection angle ($\theta$) of at least 30 degrees. Element 17: wherein the deflector ramp has a deflection angle ($\theta$) of at least 45 degrees. Element 18: wherein the deflector ramp is a deflector ramp insert. Element 19: wherein the downhole tool further includes one or more shear features coupling the shroud to the downhole end of the BHA. Element 20: wherein the shroud has a rounded nose proximate a downhole end thereof, the rounded nose engaged with a recess feature in third bore. Element 21: wherein the shroud has one or more flutes extending along a length ($L_s$) of an outer surface thereof. Element 22: wherein the BHA has one or more protrusions extending radially outward therefrom, the one or more protrusions operable to catch one or more profiles extending from an inner surface of the shroud when retrieving the BHA and shroud uphole. Element 23: wherein the BHA is coupled to coiled tubing. Element 24: wherein the one or more shear features collectively have a shear force ranging from about 500 to about 10,000 pounds. Element 25: wherein the BHA is coupled to coiled tubing, and further including fracturing at least a portion of the wellbore with the coiled tubing. Element 26: wherein pushing the downhole tool further downhole further includes pushing the downhole tool further downhole, causing a downhole end of the shroud to ride up the deflector ramp and engage with a recess feature in the third bore. Element 27: wherein selectively accessing the main wellbore or the lateral wellbore through the y-block to fracture the main wellbore or the lateral wellbore includes selectively accessing the main wellbore through the y-block to fracture the main wellbore, and further including selectively accessing the lateral wellbore through the y-block to fracture the lateral wellbore.

Those skilled in the art to which this application relates will appreciate that other and further additions, deletions, substitutions and modifications may be made to the described embodiments.

What is claimed is:

1. A downhole tool, comprising:

a bottom hole assembly (BHA) having an uphole end and a downhole end;

a shroud having a total length ($L_s$) positioned around and proximate the downhole end of the BHA, the shroud operable to slide relative to the BHA; and one or more shear features coupling the shroud to the downhole end of the BHA, the shroud configured to release from and freely slide uphole by a distance of at least two times the total length ($L_s$) relative to the BHA upon the shroud encountering a no-go feature within a wellbore and shearing of the one or more shear features, wherein a first greatest outside diameter of the shroud proximate the one or more shear features is greater than a second greatest outside diameter of the bottom home assembly that the one or more shear features couples into.

2. The downhole tool as recited in claim 1, wherein the shroud has a rounded nose proximate a downhole end thereof, the rounded nose configured to engage with a recess feature in a leg of a y-block.

3. The downhole tool as recited in claim 1, wherein the shroud has one or more fluid passageways extending along the total length ($L_s$) thereof.

4. The downhole tool as recited in claim 3, wherein the one or more fluid passageways are one or more flutes extending along the total length ($L_s$) of an outer surface thereof.

5. The downhole tool as recited in claim 1, wherein three or more shear features couple the shroud to the downhole end of the BHA, the three or more shear features radially positioned equal distance around the shroud.

6. The downhole tool as recited in claim 1, wherein the BHA has one or more protrusions extending radially outward therefrom, the one or more protrusions operable to catch one or more profiles extending from an inner surface of the shroud.

7. The downhole tool as recited in claim 6, wherein the one or more protrusions are positioned downhole of the one or more profiles, the one or more protrusions operable to catch the one or more profiles when retrieving the BHA uphole.

8. The downhole tool as recited in claim 1, wherein the BHA is coupled to coiled tubing.

9. The downhole tool as recited in claim 1, wherein the one or more shear features collectively have a minimum shear force of at least about 200 pounds.

10. The downhole tool as recited in claim 9, wherein the one or more shear features collectively have a shear force ranging from about 500 pounds to about 10,000 pounds.

11. The downhole tool as recited in claim 1, wherein the first greatest outside diameter of the shroud is significantly greater than the second greatest outside diameter of the bottom home assembly that the one or more shear features couples into.

12. The downhole tool as recited in claim 1, wherein the downhole end of the BHA resides within the shroud when the one or more shear features couple the shroud to the downhole end of the BHA.

13. The downhole tool as recited in claim 1, wherein the shroud is a deflector sleeve.

14. A well system, comprising:

a main wellbore;

a lateral wellbore extending from the main wellbore;

a multilateral junction positioned at an intersection of the main wellbore and the lateral wellbore, the multilateral junction including;

a y-block, the y-block including;

a housing having a first end and a second opposing end;

a single first bore extending into the housing from the first end, the single first bore defining a first centerline;

second and third separate bores extending into the housing and branching off from the single first bore, the second bore defining a second centerline and the third bore defining a third centerline; and a deflector ramp position at a junction between the single first bore and the second and third separate bores, the deflector ramp configured to urge a downhole tool toward the third separate bore;

a mainbore leg coupled to the second bore and extending into the main wellbore; and a lateral bore leg coupled to the third bore and extending into the lateral wellbore; and a downhole tool positioned within the y-block, the downhole tool including;

a bottom hole assembly (BHA) having an uphole end and a downhole end;

a shroud having a total length ($L_s$) positioned around the BHA and engaged with the third bore, the shroud operable to slide relative to the BHA; and one or more shear features coupling the shroud to the downhole end of the BHA, the shroud configured to release from and freely slide uphole by a distance of at least two times the total length ($L_s$) relative to the BHA upon the shroud encountering a no-go feature within the main wellbore and shearing of the one or more shear features, wherein a first greatest outside diameter of the shroud proximate the one or more shear features is greater than a second greatest outside diameter of the bottom home assembly that the one or more shear features couples into.

15. The well system as recited in claim 14, wherein the downhole tool further includes one or more shear features coupling the shroud to the downhole end of the BHA.

16. The well system as recited in claim 14, wherein the shroud has a rounded nose proximate a downhole end thereof, the rounded nose engaged with a recess feature in third bore.

17. The well system as recited in claim 14, wherein the shroud has one or more flutes extending along the total length ($L_s$) of an outer surface thereof.

18. The well system as recited in claim 14, wherein the BHA has one or more protrusions extending radially outward therefrom, the one or more protrusions operable to catch one or more profiles extending from an inner surface of the shroud when retrieving the BHA and shroud uphole.

19. The well system as recited in claim 14, wherein the BHA is coupled to coiled tubing.

20. The well system as recited in claim 14, wherein the one or more shear features collectively have a shear force ranging from about 500 to about 10,000 pounds.

21. A method for forming a well system, comprising:

placing a multilateral junction proximate an intersection between a main wellbore and a lateral wellbore, the multilateral junction including;

a y-block, the y-block including;

a housing having a first end and a second opposing end;

a single first bore extending into the housing from the first end, the single first bore defining a first centerline;

second and third separate bores extending into the housing and branching off from the single first bore, the second bore defining a second centerline and the third bore defining a third centerline; and a deflector ramp position at a junction between the single first bore and the second and third separate bores, the deflector ramp configured to urge a downhole tool toward the third separate bore;

a mainbore leg coupled to the second bore and extending into the main wellbore; and a lateral bore leg coupled to the third bore and extending into the lateral wellbore;

positioning a downhole tool within the y-block, the downhole tool including;

a bottoms hole assembly (BHA) having an uphole end and a downhole end;

a shroud having a total length ($L_s$) positioned around and proximate the downhole end of the BHA, the shroud operable to slide relative to the BHA; and one or more shear features coupling the shroud to the downhole end of the BHA, the shroud configured to release from and freely slide uphole by a distance of at least two times the total length ($L_s$) relative to the BHA upon the shroud encountering a no-go feature within a wellbore and shearing of the one or more shear features, wherein a first greatest outside diameter of the shroud proximate the one or more shear features is greater than a second greatest outside diameter of the bottom home assembly that the one or more shear features couples into;

pushing the downhole tool further downhole, causing a downhole end of the shroud to ride up the deflector ramp and engage with the third bore; and putting additional weight down on the BHA while the shroud is engaged with the third bore, the additional weight shearing the shear features and causing the BHA to enter the lateral wellbore, the shroud sliding uphole relative to the BHA by the distance of at least two times the total length ($L_s$).

22. The method as recited in claim 21, wherein the BHA is coupled to coiled tubing, and further including fracturing at least a portion of the wellbore with the coiled tubing.

23. The method as recited in claim 21, wherein pushing the downhole tool further downhole further includes pushing the downhole tool further downhole, causing a downhole end of the shroud to ride up the deflector ramp and engage with a recess feature in the third bore.

* * * * *